US011648768B2

(12) United States Patent
Nitta

(10) Patent No.: US 11,648,768 B2
(45) Date of Patent: May 16, 2023

(54) LIQUID EJECTION APPARATUS

(71) Applicant: TOSHIBA TEC KABUSHIKI KAISHA, Tokyo (JP)

(72) Inventor: Noboru Nitta, Tagata Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 47 days.

(21) Appl. No.: 17/166,865

(22) Filed: Feb. 3, 2021

(65) Prior Publication Data

US 2021/0276323 A1 Sep. 9, 2021

(30) Foreign Application Priority Data

Mar. 4, 2020 (JP) ..... JP2020-037168

(51) Int. Cl.
*B41J 2/045* (2006.01)
*B41J 2/14* (2006.01)

(52) U.S. Cl.
CPC ..... *B41J 2/04541* (2013.01); *B41J 2/04573* (2013.01); *B41J 2/04581* (2013.01); *B41J 2/04588* (2013.01); *B41J 2/14201* (2013.01)

(58) Field of Classification Search
CPC ..... B41J 2/04573
See application file for complete search history.

(56) References Cited

U.S. PATENT DOCUMENTS 6,161,926 A 12/2000 Shigemura et al.
6,296,340 B1 10/2001 Tajika et al.
7,445,306 B2 11/2008 Hirota
7,478,898 B2 1/2009 Yamada et al.
7,628,462 B2 12/2009 Iwao et al.
2002/0097286 A1 7/2002 Yasuda
2003/0227519 A1 12/2003 Ikeda et al.
2005/0174393 A1 8/2005 Mita
2006/0055717 A1* 3/2006 Hirota ..... B41J 2/155 347/71

(Continued)

FOREIGN PATENT DOCUMENTS

CN 1109822 A 10/1995
CN 1824506 A 8/2006

(Continued)

OTHER PUBLICATIONS

U.S. Appl. No. 17/166,852, filed Feb. 3, 2021.

(Continued)

*Primary Examiner* — Shelby L Fidler
(74) *Attorney, Agent, or Firm* — Kim & Stewart LLP

(57) ABSTRACT

A liquid ejection apparatus includes a liquid ejection unit with a plurality of nozzles and a corresponding plurality of actuators. A drive waveform generation circuit is configured to generate drive waveforms having different drive timings. An actuator drive circuit is configured to apply a first drive waveform to a first actuator in a liquid ejection operation and a second drive waveform to a second actuator in the liquid ejection operation during which the first and second actuators are to be driven at a same nominal time. The first driving waveform is different from the second drive waveform, and the first actuator is at a position electrically closer along a predetermined direction to a power supply electrode than is the second actuator.

20 Claims, 15 Drawing Sheets

(56) References Cited

U.S. PATENT DOCUMENTS

| | | | | |
|---|---|---|---|---|
| 2012/0019578 | A1* | 1/2012 | Van Brocklin | B41J 2/04525 347/10 |
| 2012/0120138 | A1* | 5/2012 | Banerjee | B41J 2/04581 347/10 |
| 2015/0273829 | A1 | 10/2015 | Yamashita | |
| 2017/0050434 | A1* | 2/2017 | Honda | B41J 2/04543 |
| 2018/0072056 | A1 | 3/2018 | Nitta et al. | |
| 2018/0170036 | A1* | 6/2018 | Jeapes | B41J 2/04573 |
| 2018/0229496 | A1 | 8/2018 | Kikuchi | |
| 2018/0272705 | A1 | 9/2018 | Ono et al. | |
| 2019/0091995 | A1 | 3/2019 | Nitta et al. | |
| 2019/0255851 | A1 | 8/2019 | Nitta et al. | |
| 2020/0070505 | A1 | 3/2020 | Nitta | |
| 2020/0070506 | A1 | 3/2020 | Nitta et al. | |
| 2020/0070507 | A1 | 3/2020 | Nitta | |
| 2020/0307188 | A1 | 10/2020 | Nitta et al. | |
| 2021/0276324 | A1* | 9/2021 | Martin | B41J 2/04573 |
| 2022/0250378 | A1* | 8/2022 | Martin | B41J 2/0458 |

FOREIGN PATENT DOCUMENTS

| | | | |
|---|---|---|---|
| CN | 107297952 | A | 10/2017 |
| CN | 107813609 | A | 3/2018 |
| CN | 108437636 | A | 8/2018 |
| CN | 109130490 | A | 1/2019 |
| EP | 0630751 | A2 | 12/1994 |
| EP | 1634705 | A1 | 3/2006 |
| JP | H11348271 | A | 12/1999 |
| JP | 2007203550 | A | 8/2007 |

OTHER PUBLICATIONS

Chinese Office Action dated Apr. 15, 2022, mailed in counterpart Chinese Application No. 202011221496.7, 12 pages (with translation).

Extended European Search Report dated Jul. 29, 2021, mailed in counterpart European Application No. 21159987.3, 7 pages.

* cited by examiner

FIG. 8
FOUR-CHANNEL DRIVE
| #657, #658 | #659-#824 | #825-#984 | #985-#1144 | #1145-#1310 | #1311, #1312 |
|---|---|---|---|---|---|
| DRIVEN | NOT DRIVEN | NOT DRIVEN | NOT DRIVEN | NOT DRIVEN | DRIVEN |
CHARGING WAVEFORMS OF DRIVEN CHANNELS
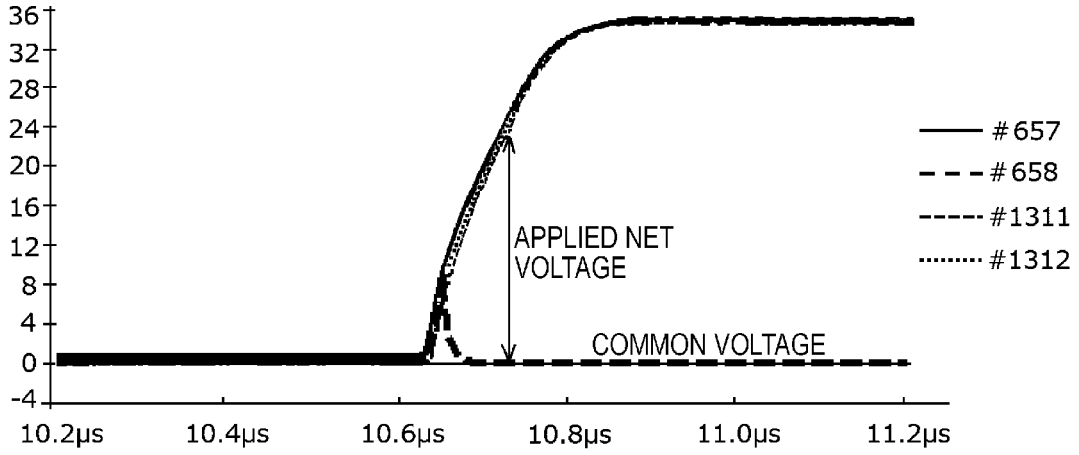
656-CHANNEL DRIVE
| #657, #658 | #659-#824 | #825-#984 | #985-#1144 | #1145-#1310 | #1311, #1312 |
|---|---|---|---|---|---|
| DRIVEN | DRIVEN | DRIVEN | DRIVEN | DRIVEN | DRIVEN |
CHARGING WAVEFORMS OF DRIVEN CHANNELS
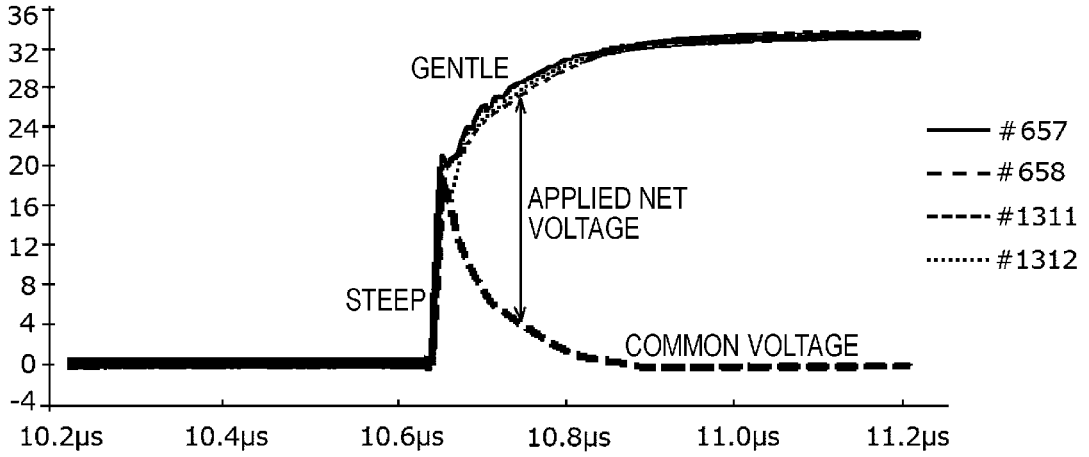

FIG. 18

DRIVE WAVEFORM SELECTION MEMORY

| | (4n+1)-TH COLUMN | (4n+2)-TH COLUMN | (4n+3)-TH COLUMN | (4n+4)-TH COLUMN |
|---|---|---|---|---|
| FIRST ROW | DELAY 0 | DELAY 4 | DELAY 0 | DELAY 4 |
| SECOND ROW | DELAY 4 | DELAY 0 | DELAY 4 | DELAY 0 |
| THIRD ROW | DELAY 0 | DELAY 4 | DELAY 0 | DELAY 4 |
| FOURTH ROW | DELAY 4 | DELAY 0 | DELAY 4 | DELAY 0 |
| FIFTH ROW | DELAY 0 | DELAY 4 | DELAY 0 | DELAY 4 |
| SIXTH ROW | DELAY 4 | DELAY 0 | DELAY 4 | DELAY 0 |
| SEVENTH ROW | DELAY 0 | DELAY 4 | DELAY 0 | DELAY 4 |
| EIGHTH ROW | DELAY 4 | DELAY 0 | DELAY 4 | DELAY 0 |

| | FIRST COLUMN | SECOND COLUMN | THIRD COLUMN | FOURTH COLUMN | FIFTH COLUMN | SIXTH COLUMN | SEVENTH COLUMN | EIGHTH COLUMN | NINTH COLUMN | TENTH COLUMN | ELEVENTH COLUMN | TWELFTH COLUMN |
|---|---|---|---|---|---|---|---|---|---|---|---|---|
| FIRST ROW | 0.00 | 2.00 | 0.00 | 2.00 | 0.00 | 2.00 | 0.00 | 2.00 | 0.00 | 2.00 | 0.00 | 2.00 |
| SECOND ROW | 2.00 | 0.00 | 2.00 | 0.00 | 2.00 | 0.00 | 2.00 | 0.00 | 2.00 | 0.00 | 2.00 | 0.00 |
| THIRD ROW | 0.00 | 2.00 | 0.00 | 2.00 | 0.00 | 2.00 | 0.00 | 2.00 | 0.00 | 2.00 | 0.00 | 2.00 |
| FOURTH ROW | 2.00 | 0.00 | 2.00 | 0.00 | 2.00 | 0.00 | 2.00 | 0.00 | 2.00 | 0.00 | 2.00 | 0.00 |
| FIFTH ROW | 0.00 | 2.00 | 0.00 | 2.00 | 0.00 | 2.00 | 0.00 | 2.00 | 0.00 | 2.00 | 0.00 | 2.00 |
| SIXTH ROW | 2.00 | 0.00 | 2.00 | 0.00 | 2.00 | 0.00 | 2.00 | 0.00 | 2.00 | 0.00 | 2.00 | 0.00 |
| SEVENTH ROW | 0.00 | 2.00 | 0.00 | 2.00 | 0.00 | 2.00 | 0.00 | 2.00 | 0.00 | 2.00 | 0.00 | 2.00 |
| EIGHTH ROW | 2.00 | 0.00 | 2.00 | 0.00 | 2.00 | 0.00 | 2.00 | 0.00 | 2.00 | 0.00 | 2.00 | 0.00 |

DRIVE WAVEFORM SELECTION MEMORY

| | (4n+1)-TH COLUMN | (4n+2)-TH COLUMN | (4n+3)-TH COLUMN | (4n+4)-TH COLUMN |
|---|---|---|---|---|
| FIRST ROW | DELAY 0 | DELAY 4 | DELAY 0 | DELAY 4 |
| SECOND ROW | DELAY 4 | DELAY 0 | DELAY 4 | DELAY 0 |
| THIRD ROW | DELAY 4 | DELAY 0 | DELAY 4 | DELAY 0 |
| FOURTH ROW | DELAY 0 | DELAY 4 | DELAY 0 | DELAY 4 |
| FIFTH ROW | DELAY 0 | DELAY 4 | DELAY 0 | DELAY 4 |
| SIXTH ROW | DELAY 4 | DELAY 0 | DELAY 4 | DELAY 0 |
| SEVENTH ROW | DELAY 4 | DELAY 0 | DELAY 4 | DELAY 0 |
| EIGHTH ROW | DELAY 0 | DELAY 4 | DELAY 0 | DELAY 4 |

| | FIRST COLUMN | SECOND COLUMN | THIRD COLUMN | FOURTH COLUMN | FIFTH COLUMN | SIXTH COLUMN | SEVENTH COLUMN | EIGHTH COLUMN | NINTH COLUMN | TENTH COLUMN | ELEVENTH COLUMN | TWELFTH COLUMN |
|---|---|---|---|---|---|---|---|---|---|---|---|---|
| FIRST ROW | 0.00 | 2.00 | 0.00 | 2.00 | 0.00 | 2.00 | 0.00 | 2.00 | 0.00 | 2.00 | 0.00 | 2.00 |
| SECOND ROW | 2.00 | 0.00 | 2.00 | 0.00 | 2.00 | 0.00 | 2.00 | 0.00 | 2.00 | 0.00 | 2.00 | 0.00 |
| THIRD ROW | 2.00 | 0.00 | 2.00 | 0.00 | 2.00 | 0.00 | 2.00 | 0.00 | 2.00 | 0.00 | 2.00 | 0.00 |
| FOURTH ROW | 0.00 | 2.00 | 0.00 | 2.00 | 0.00 | 2.00 | 0.00 | 2.00 | 0.00 | 2.00 | 0.00 | 2.00 |
| FIFTH ROW | 0.00 | 2.00 | 0.00 | 2.00 | 0.00 | 2.00 | 0.00 | 2.00 | 0.00 | 2.00 | 0.00 | 2.00 |
| SIXTH ROW | 2.00 | 0.00 | 2.00 | 0.00 | 2.00 | 0.00 | 2.00 | 0.00 | 2.00 | 0.00 | 2.00 | 0.00 |
| SEVENTH ROW | 2.00 | 0.00 | 2.00 | 0.00 | 2.00 | 0.00 | 2.00 | 0.00 | 2.00 | 0.00 | 2.00 | 0.00 |
| EIGHTH ROW | 0.00 | 2.00 | 0.00 | 2.00 | 0.00 | 2.00 | 0.00 | 2.00 | 0.00 | 2.00 | 0.00 | 2.00 |

DRIVE WAVEFORM SELECTION MEMORY

| | FIRST COLUMN | SECOND COLUMN | THIRD COLUMN | FOURTH COLUMN |
|---|---|---|---|---|
| FIRST ROW | DELAY 0 | DELAY 1 | DELAY 2 | DELAY 3 |
| SECOND ROW | DELAY 4 | DELAY 5 | DELAY 6 | DELAY 7 |
| THIRD ROW | DELAY 0 | DELAY 1 | DELAY 2 | DELAY 3 |
| FOURTH ROW | DELAY 4 | DELAY 5 | DELAY 6 | DELAY 7 |
| FIFTH ROW | DELAY 0 | DELAY 1 | DELAY 2 | DELAY 3 |
| SIXTH ROW | DELAY 4 | DELAY 5 | DELAY 6 | DELAY 7 |
| SEVENTH ROW | DELAY 0 | DELAY 1 | DELAY 2 | DELAY 3 |
| EIGHTH ROW | DELAY 4 | DELAY 5 | DELAY 6 | DELAY 7 |

| | FIRST COLUMN | SECOND COLUMN | THIRD COLUMN | FOURTH COLUMN | FIFTH COLUMN | SIXTH COLUMN | SEVENTH COLUMN | EIGHTH COLUMN | NINTH COLUMN | TENTH COLUMN | ELEVENTH COLUMN | TWELFTH COLUMN |
|---|---|---|---|---|---|---|---|---|---|---|---|---|
| FIRST ROW | 0.00 | 0.50 | 1.00 | 1.50 | 0.00 | 0.50 | 1.00 | 1.50 | 0.00 | 0.50 | 1.00 | 1.50 |
| SECOND ROW | 2.00 | 2.50 | 3.00 | 3.50 | 2.00 | 2.50 | 3.00 | 3.50 | 2.00 | 2.50 | 3.00 | 3.50 |
| THIRD ROW | 0.00 | 0.50 | 1.00 | 1.50 | 0.00 | 0.50 | 1.00 | 1.50 | 0.00 | 0.50 | 1.00 | 1.50 |
| FOURTH ROW | 2.00 | 2.50 | 3.00 | 3.50 | 2.00 | 2.50 | 3.00 | 3.50 | 2.00 | 2.50 | 3.00 | 3.50 |
| FIFTH ROW | 0.00 | 0.50 | 1.00 | 1.50 | 0.00 | 0.50 | 1.00 | 1.50 | 0.00 | 0.50 | 1.00 | 1.50 |
| SIXTH ROW | 2.00 | 2.50 | 3.00 | 3.50 | 2.00 | 2.50 | 3.00 | 3.50 | 2.00 | 2.50 | 3.00 | 3.50 |
| SEVENTH ROW | 0.00 | 0.50 | 1.00 | 1.50 | 0.00 | 0.50 | 1.00 | 1.50 | 0.00 | 0.50 | 1.00 | 1.50 |
| EIGHTH ROW | 2.00 | 2.50 | 3.00 | 3.50 | 2.00 | 2.50 | 3.00 | 3.50 | 2.00 | 2.50 | 3.00 | 3.50 |

DRIVE WAVEFORM SELECTION MEMORY

| | FIRST COLUMN | SECOND COLUMN | THIRD COLUMN | FOURTH COLUMN |
|---|---|---|---|---|
| FIRST ROW | DELAY 0 | DELAY 2 | DELAY 4 | DELAY 6 |
| SECOND ROW | DELAY 4 | DELAY 6 | DELAY 0 | DELAY 2 |
| THIRD ROW | DELAY 0 | DELAY 2 | DELAY 4 | DELAY 6 |
| FOURTH ROW | DELAY 4 | DELAY 6 | DELAY 0 | DELAY 2 |
| FIFTH ROW | DELAY 0 | DELAY 2 | DELAY 4 | DELAY 6 |
| SIXTH ROW | DELAY 4 | DELAY 6 | DELAY 0 | DELAY 2 |
| SEVENTH ROW | DELAY 0 | DELAY 2 | DELAY 4 | DELAY 6 |
| EIGHTH ROW | DELAY 4 | DELAY 6 | DELAY 0 | DELAY 2 |

| | FIRST COLUMN | SECOND COLUMN | THIRD COLUMN | FOURTH COLUMN | FIFTH COLUMN | SIXTH COLUMN | SEVENTH COLUMN | EIGHTH COLUMN | NINTH COLUMN | TENTH COLUMN | ELEVENTH COLUMN | TWELFTH COLUMN |
|---|---|---|---|---|---|---|---|---|---|---|---|---|
| FIRST ROW | 0.00 | 1.00 | 2.00 | 3.00 | 0.00 | 1.00 | 2.00 | 3.00 | 0.00 | 1.00 | 2.00 | 3.00 |
| SECOND ROW | 2.00 | 3.00 | 0.00 | 1.00 | 2.00 | 3.00 | 0.00 | 1.00 | 2.00 | 3.00 | 0.00 | 1.00 |
| THIRD ROW | 0.00 | 1.00 | 2.00 | 3.00 | 0.00 | 1.00 | 2.00 | 3.00 | 0.00 | 1.00 | 2.00 | 3.00 |
| FOURTH ROW | 2.00 | 3.00 | 0.00 | 1.00 | 2.00 | 3.00 | 0.00 | 1.00 | 2.00 | 3.00 | 0.00 | 1.00 |
| FIFTH ROW | 0.00 | 1.00 | 2.00 | 3.00 | 0.00 | 1.00 | 2.00 | 3.00 | 0.00 | 1.00 | 2.00 | 3.00 |
| SIXTH ROW | 2.00 | 3.00 | 0.00 | 1.00 | 2.00 | 3.00 | 0.00 | 1.00 | 2.00 | 3.00 | 0.00 | 1.00 |
| SEVENTH ROW | 0.00 | 1.00 | 2.00 | 3.00 | 0.00 | 1.00 | 2.00 | 3.00 | 0.00 | 1.00 | 2.00 | 3.00 |
| EIGHTH ROW | 2.00 | 3.00 | 0.00 | 1.00 | 2.00 | 3.00 | 0.00 | 1.00 | 2.00 | 3.00 | 0.00 | 1.00 |

LIQUID EJECTION APPARATUS

CROSS-REFERENCE TO RELATED APPLICATION

This application is based upon and claims the benefit of priority from Japanese Patent Application No. 2020-037168, filed on Mar. 4, 2020, the entire contents of which are incorporated herein by reference.

FIELD

Embodiments described herein relate generally to a liquid ejection apparatus.

BACKGROUND

A liquid ejection apparatus that supplies a predetermined amount of liquid to a predetermined position is known. Such a liquid ejection apparatus is installed in, for example, an inkjet printer, a 3D printer, a liquid dispensing apparatus, or the like. An inkjet printer ejects ink droplets from an inkjet head to form an image or the like on a surface of a recording medium. A 3D printer ejects droplets of a molding material from a molding material ejection head and the droplets harden to form a three-dimensional modeled object. A liquid dispensing apparatus ejects sample droplets of known volume to supply a predetermined amount of the sample to a plurality of containers or the like.

A liquid ejection apparatus has a plurality of channels including nozzles and actuators for forming droplets or dots. The liquid ejection apparatus selects a channel from among the plurality of channels for ejecting a liquid and drive the actuator of the selected channel by applying a drive waveform thereto. When the number of actuators to be driven is large, especially when the actuators are positioned close to each other, the actuators are affected by, for example, concentration of an electric current flowing through a common electrode to which the actuators are commonly connected, or pressure oscillation occurring between the channels. Thus, the amount of liquid ejection may become unstable.

Hence, there is a need for a liquid ejection apparatus capable of stable liquid ejection.

BRIEF DESCRIPTION OF THE DRAWINGS

FIG. 8 depicts example voltage waveforms according to a first embodiment.

FIG. 18 depicts an example delay pattern and delay amount according to a first embodiment.

DETAILED DESCRIPTION

Figure 1:
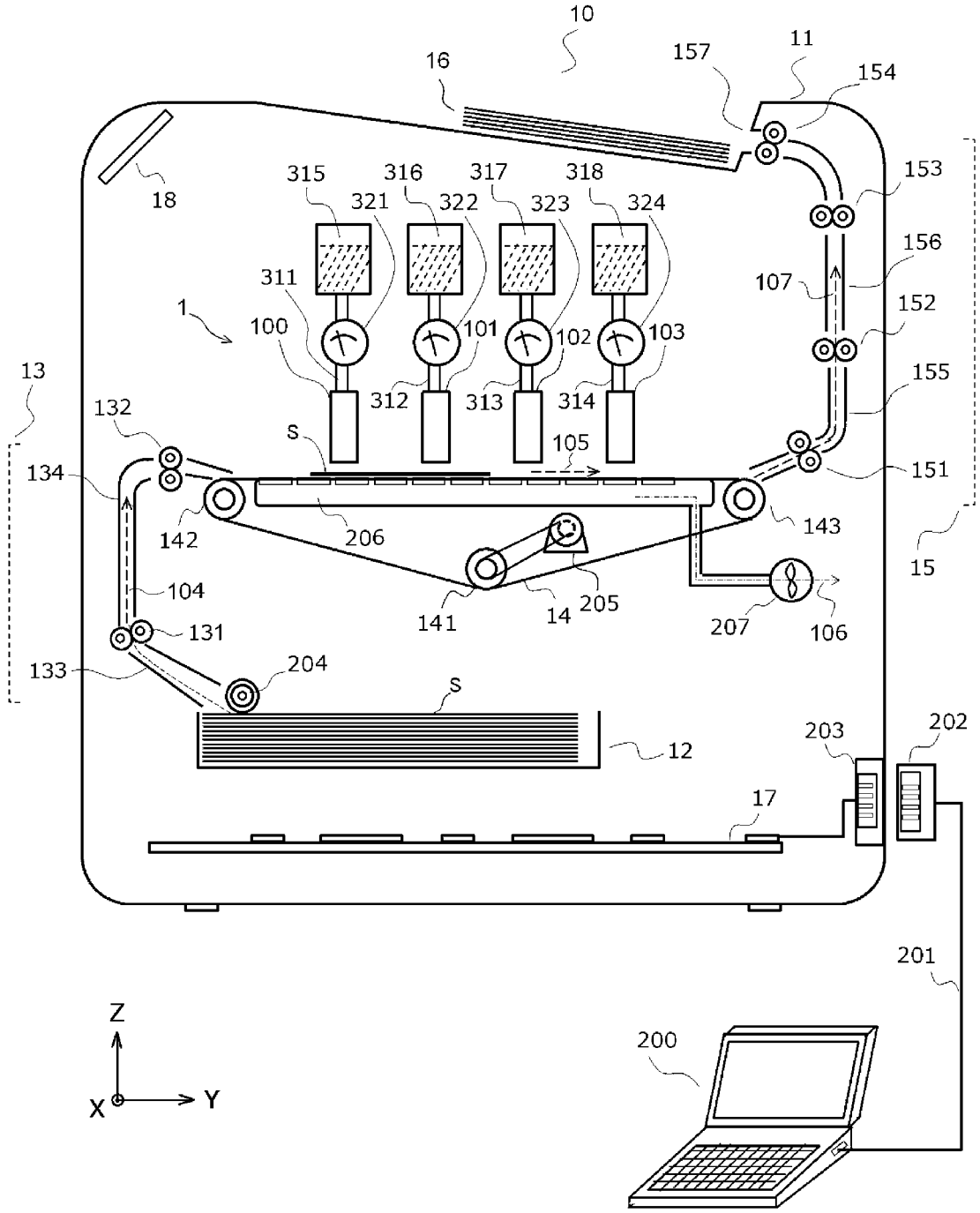
FIG. 1 depicts an inkjet printer according to a first embodiment.

According to an embodiment, a liquid ejection apparatus comprises a liquid ejection unit having a plurality of nozzles and a corresponding plurality of actuators. A drive waveform generation circuit of the apparatus is configured to generate drive waveforms having different drive timings. An actuator drive circuit of the apparatus is configured to apply a first drive waveform to a first actuator in a liquid ejection operation and a second drive waveform to a second actuator in the liquid ejection operation during which the first and second actuators are to be driven at a same nominal time. The first driving waveform and the second drive waveform have different drive timings, and the first actuator is at a position electrically closer along a predetermined direction to a power supply electrode than is the second actuator.

Hereinafter, certain embodiments of a liquid ejection apparatus will be described with reference to the accompanying drawings. In the respective drawings, the same components depicted in different drawings will be denoted by the same reference numerals.

First Embodiment

As an example of an image forming apparatus equipped with a liquid ejection apparatus 1 according to a first embodiment, an inkjet printer 10 for printing an image on a recording medium will be described. FIG. 1 shows a schematic configuration of the inkjet printer 10. Inside a housing 11 of the inkjet printer 10, a cassette 12 that accommodates sheets S, which are an example of a recording medium, an upstream conveyance path 13 for the sheets S, a conveyance belt 14 that conveys each sheet S picked up from the cassette 12, inkjet heads 100, 101, 102, and 103 that eject ink droplets toward a sheet S on the conveyance belt 14, a downstream conveyance path 15 for the sheets S, a discharge tray 16, and a controller 17 are disposed. An input operation unit 18, which is a user interface panel or the like, is disposed on an upper side of the housing 11.

Image data to be printed on the sheet S is generated by, for example, a computer 200, which is an external device connectable to the inkjet printer 10. The image data generated by the computer 200 is transmitted to the controller 17 of the inkjet printer 10 through a cable 201 and connectors 202 and 203.

A pick-up roller 204 supplies the sheets S from the cassette 12 and moves the sheets S to the upstream conveyance path 13 one by one. The upstream conveyance path 13 includes feed roller pairs 131 and 132 and sheet guide plates 133 and 134. Each sheet S is moved to an upper surface of the conveyance belt 14 by the upstream conveyance path 13. In the drawing, an arrow 104 indicates a conveyance path of the sheets S from the cassette 12 to the conveyance belt 14.

The conveyance belt 14 is a mesh-like endless belt having a large number of through holes formed on the surface thereof. Three rollers including a driving roller 141 and driven rollers 142 and 143 rotatably support the conveyance belt 14. A motor 205 rotates the conveyance belt 14 by rotating the driving roller 141. The motor 205 is an example of a driving device. In the drawing, arrow 105 indicates a rotation direction of the conveyance belt 14. A negative pressure container 206 is disposed on a back side of the conveyance belt 14. The negative pressure container 206 is connected to a pressure reducing fan 207. The inside of the negative pressure container 206 becomes a negative pressure due to an air current generated by the fan 207, and thus the sheet S is held on the upper surface of the conveyance belt 14 by an air pressure difference force (vacuum). In the drawing, arrow 106 indicates a flow direction of an air current.

The inkjet heads 100 to 103 are disposed so as to face the sheet S on the conveyance belt 14 at a narrow gap of, for example, 1 mm between the sheet S and the lowermost portion of the inkjet heads 100 to 103. The inkjet heads 100 to 103 individually eject ink droplets toward the sheet S. An image is formed on the sheet S when the sheet S passes below all of the inkjet heads 100 to 103. The inkjet heads 100 to 103 each have the same structure except that colors of ink to be ejected therefrom are different. The colors of the ink are, for example, cyan, magenta, yellow, and black.

The inkjet heads 100 to 103 are respectively connected to ink tanks 315, 316, 317, and 318 and ink supply pressure adjustment devices 321, 322, 323, and 324 through ink flow paths 311, 312, 313, and 314. When an image is being formed, the ink in the ink tanks 315 to 318 is supplied to the inkjet heads 100 to 103 by the ink supply pressure adjustment devices 321 to 324, respectively.

After the image is formed, the sheet S is transmitted from the conveyance belt 14 to the downstream conveyance path 15. The downstream conveyance path 15 includes feed roller pairs 151, 152, 153, and 154, and sheet guide plates 155 and 156 that form a conveyance path of the sheet S. The sheet S is ejected from a discharge port 157 to the discharge tray 16 from the downstream conveyance path 15. In the drawing, arrow 107 indicates a conveyance path of the sheet S when on the downstream conveyance path 15.

Next, the configuration of each of the inkjet heads 100 to 103 will be described. Since the inkjet heads 101 to 103 have the same structure as the structure of the inkjet head 100, the inkjet head 100 will be described as representative by reference to FIGS. 2 to 4.

Figure 2:
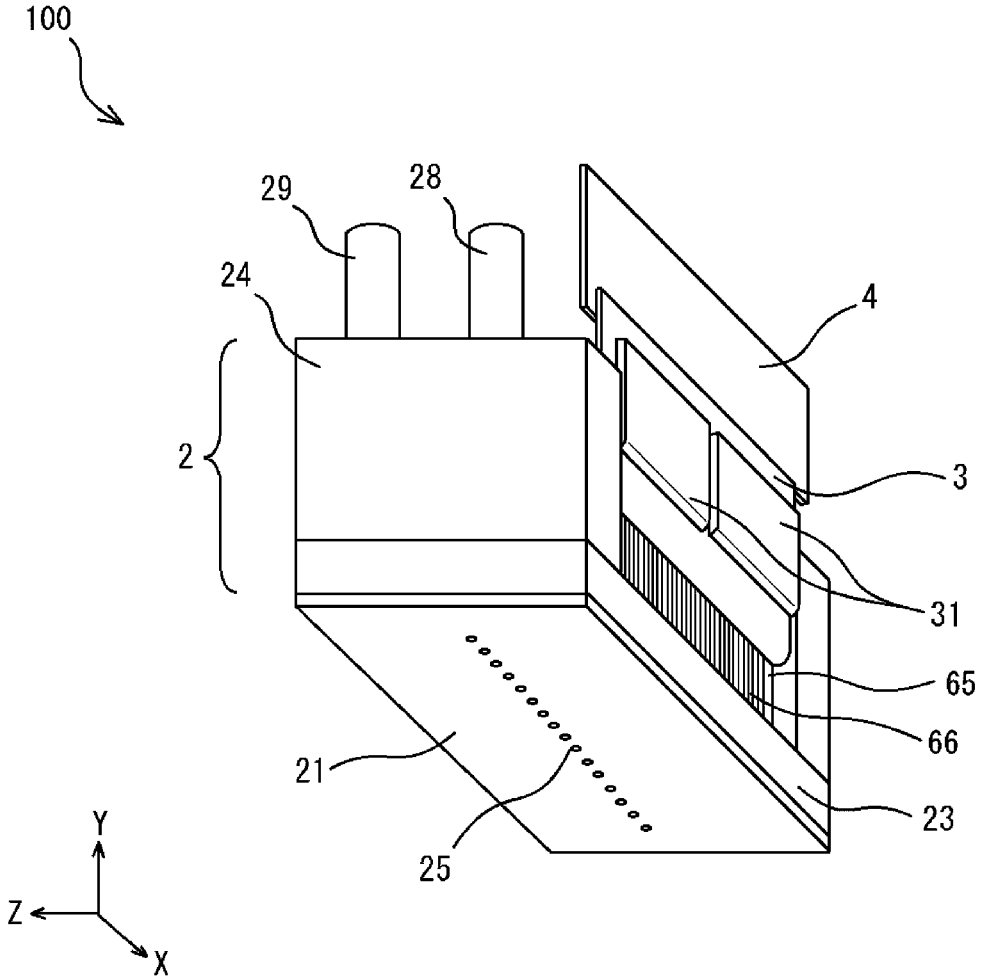
FIG. 2 depicts an inkjet head in a perspective view according to a first embodiment.
Figure 3:
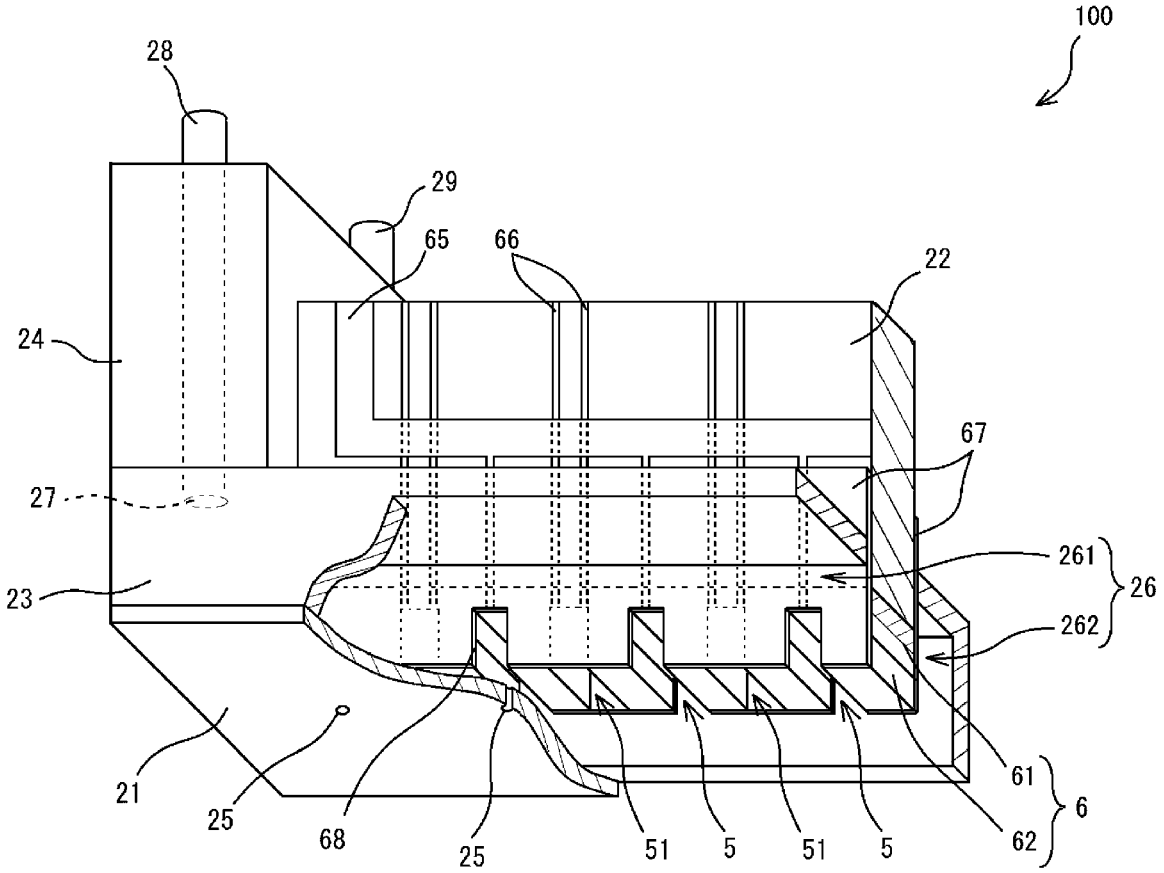
FIG. 3 depicts an internal configuration of an inkjet head according to a first embodiment.
Figure 4:
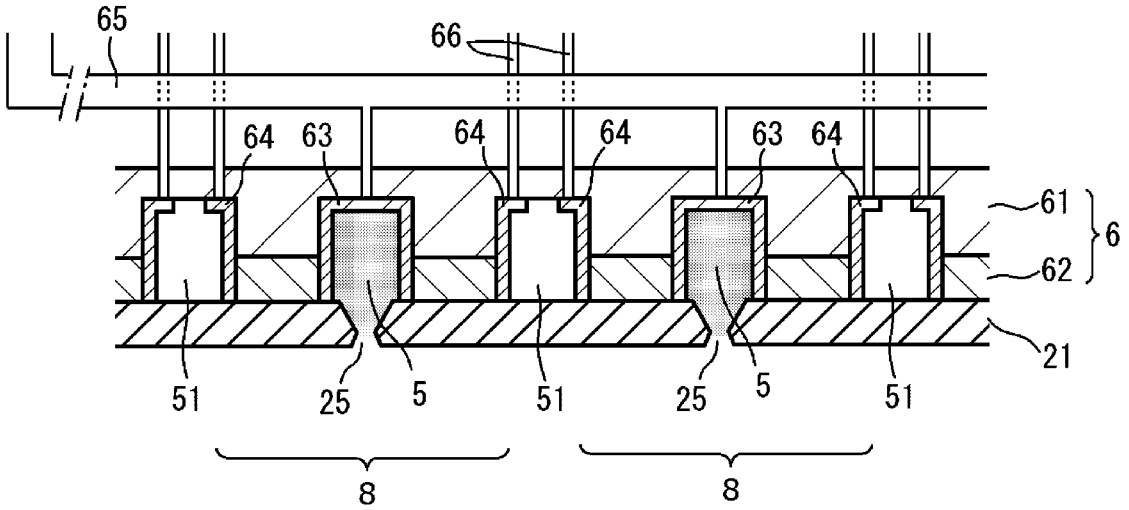
FIG. 4 depicts an actuator of an inkjet head in a cross-sectional view according to a first embodiment.

As shown in FIGS. 2 to 4, the inkjet head 100 includes a nozzle head unit 2, which is an example of a liquid ejection unit, a flexible printed wiring board 3, which is an example of a film carrier package, and a drive circuit board 4. The nozzle head unit 2 includes a nozzle plate 21, an actuator substrate 22 providing a plurality of actuators, a frame member 23 that forms a common ink chamber 26, and an ink supply unit 24 that supplies ink to the common ink chamber 26.

The nozzle plate 21 is a rectangular plate that can be made of resin, such as polyimide, or metal, such as stainless steel. A plurality of nozzles 25 that eject ink are formed on a surface of the nozzle plate 21. The nozzle density of the nozzle plate 21 is set to be in a range of, for example, 150 to 1200 dpi. The actuator substrate 22 is, for example, a rectangular substrate made of insulating ceramics.

The frame member 23 surrounds a lower part of the actuator substrate 22. An opening of a lower surface of the frame member 23 is sealed by the nozzle plate 21. A space partitioned by the frame member 23, the actuator substrate 22 and the nozzle plate 21 forms the common ink chamber 26. The common ink chamber 26 comprises common ink chamber portions 261 and 262 with the actuator substrate 22 interposed therebetween. One common ink chamber portion 261 communicates with an ink supply port 27 and functions as an ink supply path that supplies ink to a plurality of pressure chambers 5. The ink supply port 27 is connected to the ink supply pressure adjustment device 321 (see FIG. 1) through an ink supply tube 28. The common ink chamber portion 262 communicates with an ink drain port connected to ink drain tube 29 in a manner similar to ink supply port 27 and ink supply tube 28. The common chamber portion 262 functions as an ink drain path by which supplied ink is removed from the plurality of pressure chambers 5. The ink drain port is connected via ink drain tube 29 to the ink supply pressure adjustment device 321 to circulate ink through the inkjet head 100.

As shown in FIGS. 3 and 4, a plurality of pressure chambers 5, which form the ink ejection channels together with the nozzles 25, and a plurality of air chambers 51, which form dummy channels, are formed on a surface of the actuator substrate 22 positioned in the common ink chamber 26. The pressure chambers 5 and the air chambers 51 are separated by a piezoelectric member 6 that forms a side wall. The pressure chamber 5 and the air chamber 51 are formed by grooves formed by cutting into the two piezoelectric members 61 and 62 forming the piezoelectric member 6 which is laminated on the surface of the actuator substrate 22. The grooves are formed in a rectangular shape along the width direction of the substrate. The two piezoelectric members 61 and 62 are laminated together with their polarization directions being opposite to each other (for example, a facing direction). Each pressure chamber 5 communicates with a nozzle 25 on a one-to-one basis. The air chambers 51 are arranged to be positioned on both sides of a pressure chamber 5.

Two cover plates 67 that each forma side wall on the opposite short sides of the air chamber 51 are respectively provided on both outer facing surfaces of the actuator substrate 22. The ends of the air chambers 51 are blocked off from the common ink chamber 26 (more particularly, one end is blocked off from common ink chamber portion 261 and the other end is blocked off from common ink chamber portion 262) by the cover plates 67. Each cover plate 67 is formed of, for example, a zirconia plate having a thickness of about 50 μm. In the cover plate 67, groove-shaped openings 68 corresponding to the shape and positions of the pressure chambers 5 are formed so that the pressure chambers 5 are open to both the common ink chamber portions 261 and 262 and ink can flow through the pressure chambers 5 from the common ink chamber portion 261 to the common ink chamber portion 262. That is, so the common ink chamber portions 261 and 262 can communicate with each other. The opening 68 of the cover plate 67 on the common ink chamber portion 261 side can be referred to as an ink supply port, the opening 68 of the cover plate 67 on the common ink chamber portion 262 side can be referred to as an ink drain port. Ink is supplied to, and flows from, the pressure chambers 5 through these ink supply and drain ports.

As shown in FIG. 4, an electrode 63 is integrally formed on an upper surface and side surfaces of each of the pressure chambers 5. Furthermore, electrically separated electrodes 64 are respectively formed on each side surface (left side and right side surfaces in the drawing) of each of the air chambers 51. The electrodes 63 are each connected to a common electrode 65. The electrodes 64 are each connected to and individual electrodes 66. The common electrode 65 and the individual electrodes 64 may be referred to as wiring electrodes. A contact point between the electrode 63 of a pressure chamber 5 and the common electrode 65 is one terminal of an actuator 8, and a contact point between an electrode 64 of an adjacent air chamber 51 and the corresponding individual electrode 66 is the other terminal of the actuator 8. The electrodes 63 and 64, the common electrode 65, and the individual electrodes 66 are formed of, for example, a thin nickel film. The common electrode 65 and the individual electrodes 66 on the actuator substrate 22 are insulated by, for example, an insulating layer (not separately depicted). For example, the common electrode 65 is grounded. The individual electrodes 66 apply a drive voltage to the actuator 8 of each channel. With this configuration, an electric field is applied in a direction intersecting (for example, orthogonally intersecting) with a polarization axis of the piezoelectric member 6 (more particularly, the piezoelectric portions 61 and 62), and the piezoelectric member 6 on both sides of the pressure chamber 5 is shear-mode deformed. Thereby, inside of the pressure chamber 5 is compressed, and ink is ejected from the nozzle 25. This forms a capacitance type actuator 8 of a shear mode type.

Referring back to FIG. 2, the common electrode 65 and the individual electrodes 66 are electrically connected to the flexible printed wiring board 3, and the flexible printed wiring board 3 is electrically connected to the drive circuit board 4. The flexible printed wiring board 3 includes an integrated circuit (IC) 31 for driving particular electrodes corresponding to particular nozzles 25. The drive circuit board 4 temporarily stores print data received from the controller 17 (FIG. 1) of the inkjet printer 10 and applies a drive voltage to the actuators 8 so as to eject ink at a predetermined timing.

Figure 5:
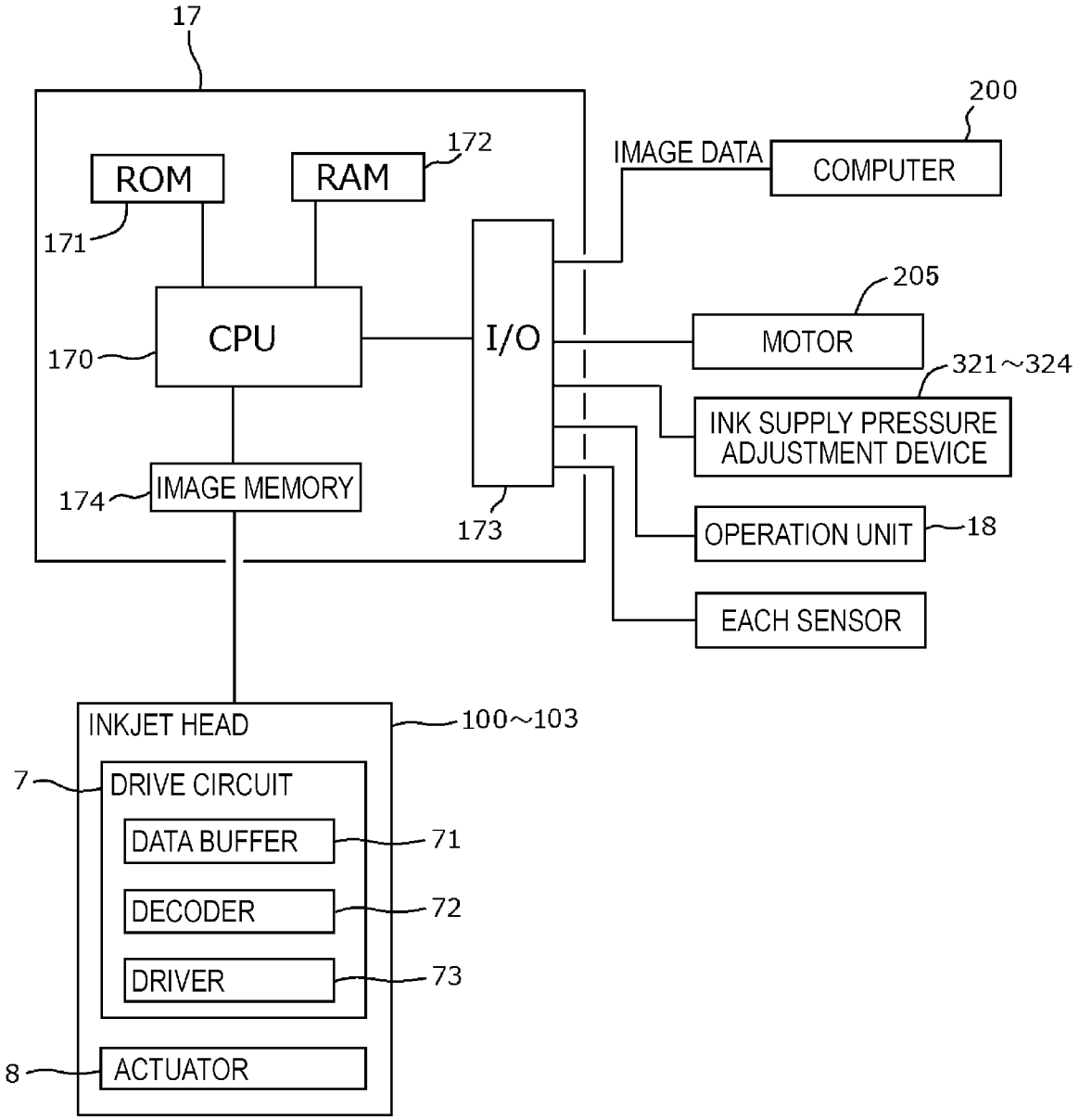
FIG. 5 is a block configuration diagram of a control system of an inkjet printer according to a first embodiment.

FIG. 5 is a block configuration diagram of a control system of the inkjet printer 10. The controller 17 includes a CPU 170, a ROM 171, a RAM 172, an I/O port 173, and an image memory 174. The CPU 170 controls the motor 205, the ink supply pressure adjustment devices 321 to 324, the operation unit 18, and various sensors with signals through the I/O port 173. The image data from the computer 200, which is an external device communicably connected to the inkjet printer 10, is transmitted to the controller 17 through the I/O port 173 and stored in the image memory 174. The CPU 170 transmits the image data stored in the image memory 174 to a drive circuit 7 in the appropriate order for image forming or printing. The drive circuit 7 comprises the flexible printed wiring board 3 and the drive circuit board 4.

The drive circuit 7 includes a print data buffer 71, which is a channel data supply unit, a decoder 72, and a driver 73. The print data buffer 71 stores the image data in time series for each channel. The decoder 72 controls the driver 73 for each channel based on the image data stored in the print data buffer 71. The driver 73 applies a drive waveform to each actuator 8 of each channel based on the control of the decoder 72.

Figure 6:
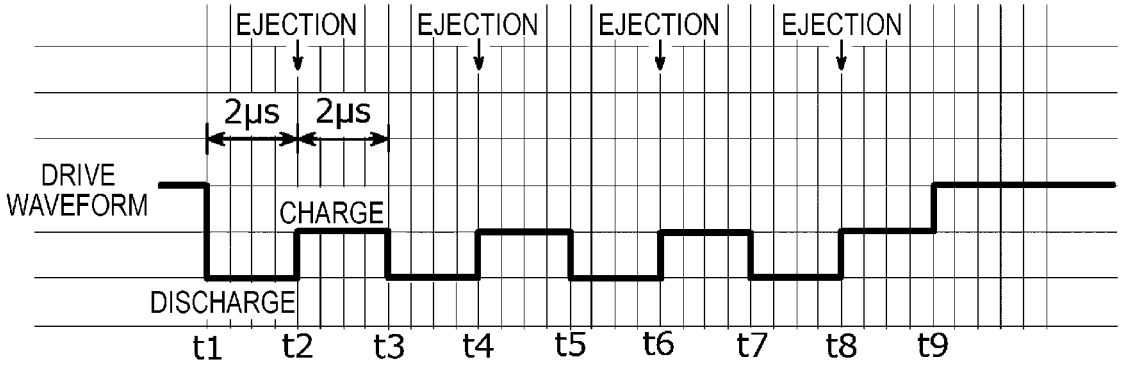
FIG. 6 depicts an example actuator drive waveform according to a first embodiment.

Next, referring to FIG. 6, the drive waveform for the actuator 8 will be described. FIG. 6 shows, as an example of the drive waveform, a multi-drop drive waveform in which ink is dispensed four times (four droplets) in one drive cycle to form dots on the recording medium (e.g., sheet S). This drive waveform is a so-called "pull drive waveform." The drive waveform is not limited to the waveform in which four droplets are dispensed and, in general, any number of droplets of one or more can be adopted. The drive waveform is not limited to the pull drive waveform. For example, a push drive waveform or a push-pull drive waveform may be used.

The drive waveform applies a bias voltage to the capacitance type actuator 8 until time t1, which is the start of the ink discharge operation. Next, after a discharge from time t1 to time t2, a charge voltage is applied from time t2 to time t3, thereby performing the first ink droplet ejection. After a discharge from time t3 to time t4, a charge voltage is applied from time t4 to time t5, thereby performing the second ink droplet ejection. After a discharge from time t5 to time t6, a charge voltage is applied from time t6 to time t7, thereby performing the third ink droplet ejection. After a discharge from time t7 to time t8, a charge voltage is applied from time t8 to time 9, thereby performing the fourth ink droplet ejection. The bias voltage is again applied at time t9 after the completion of the last droplet ejection to attenuate residual oscillation in the pressure chamber 5.

The voltage applied at the time of ink ejection is smaller than the bias voltage, and a voltage value is determined based on, for example, an attenuation rate of pressure oscillation in the pressure chamber 5. A time period between time t1 and time t2, a time period between time t2 and time t3, a time period between time t3 and time t4, a time period between time t4 and time t5, a time period between time t5 and time t6, a time period between time t6 and time t7, a time period between time t7 and time t8, and a time period between time t8 and time t9 are respectively set to a half cycle of an oscillation cycle $\lambda$ of an inherent pressure oscillation that is determined by, for example, characteristics of ink being ejected and an internal structure dimensions of the inkjet head. The half cycle of the inherent oscillation cycle $\lambda$ is also referred to as an acoustic length (AL). For example, when the oscillation cycle $\lambda$ is 4 μs, the half cycle is 2 μs.

Figure 7:
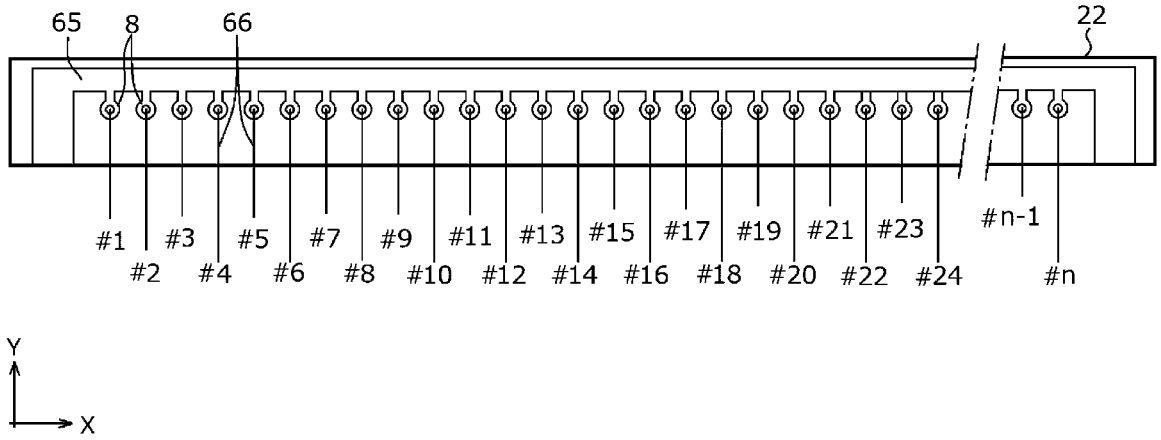
FIG. 7 depicts an example arrangement of actuators and electrodes according to a first embodiment.

FIG. 7 schematically shows an example arrangement of the actuators 8 (#1, #2, #3 . . . #n) on the actuator substrate 22 and the wiring of the common electrodes 65 and the individual electrodes 66. For convenience of drawing, the structure of each actuator 8 is simplified. One terminal of the actuator 8 is connected to the common electrode 65. The other terminal of the actuator 8 is connected to an individual electrode 66. In this case, when a large number of actuators 8 are driven at the same time, a large current flows in the common electrode 65 and a voltage drop occurs on the common electrode 65. This may deform the voltage waveform being applied to the actuators 8 located at a position far away from voltage supply units (which are at left and right ends in the drawing), that is, for example, a position near the center, and the ink may not be ejected in a desired or expected manner.

Comparing the case of driving four actuators 8 at the same time and the case of driving 656 actuators 8 at the same time by using the inkjet head 100 equipped with 1312 actuators 8, the voltage waveform deforms as shown in FIG. 8. This indicates that when the number of actuators 8 that are driven at the same time is small, the charge of the actuators 8 starts immediately after the start of energization. On the other hand, when the number of actuators 8 that are driven at the same time is large, at the initial stage of the actuator charge, the ground (Gnd) potential rises and the charging current does not flow, thereby causing the waveform to rise steeply at the beginning. Thereafter, since the actuator charge is performed through a resistance of the common electrode 65, the rising of the waveform becomes gentle. As a result, the net voltage applied to the actuator 8 decreases, and the ink ejection speed decreases.

Figure 9:
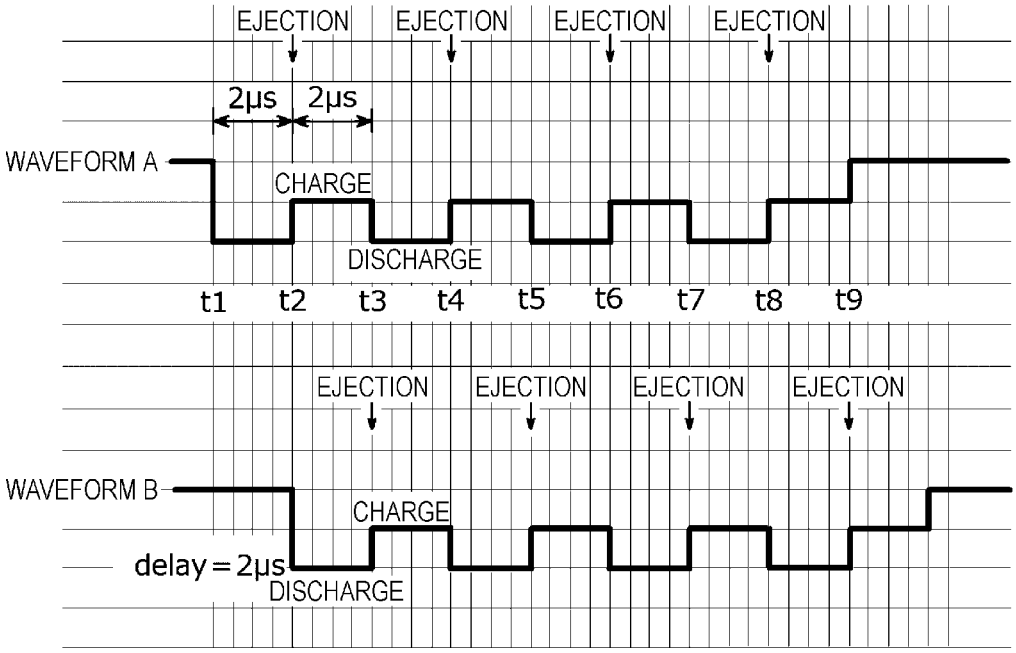
FIG. 9 depicts example actuator drive waveforms according to a first embodiment.

In order to alleviate the current concentration in the common electrode 65, as shown in FIG. 9, a drive waveform A and a drive waveform B, whose drive timings are mutually shifted are selectively applied to the actuators 8. The drive timing of the drive waveform B is delayed with respect to the drive waveform A by a half cycle (for example, 2 μs) of the oscillation cycle λ of pressure oscillation. By delaying the drive timing in this manner, the drive waveform B has an opposite phase with respect to the drive waveform A between time t2 to time t8.

Figure 10:
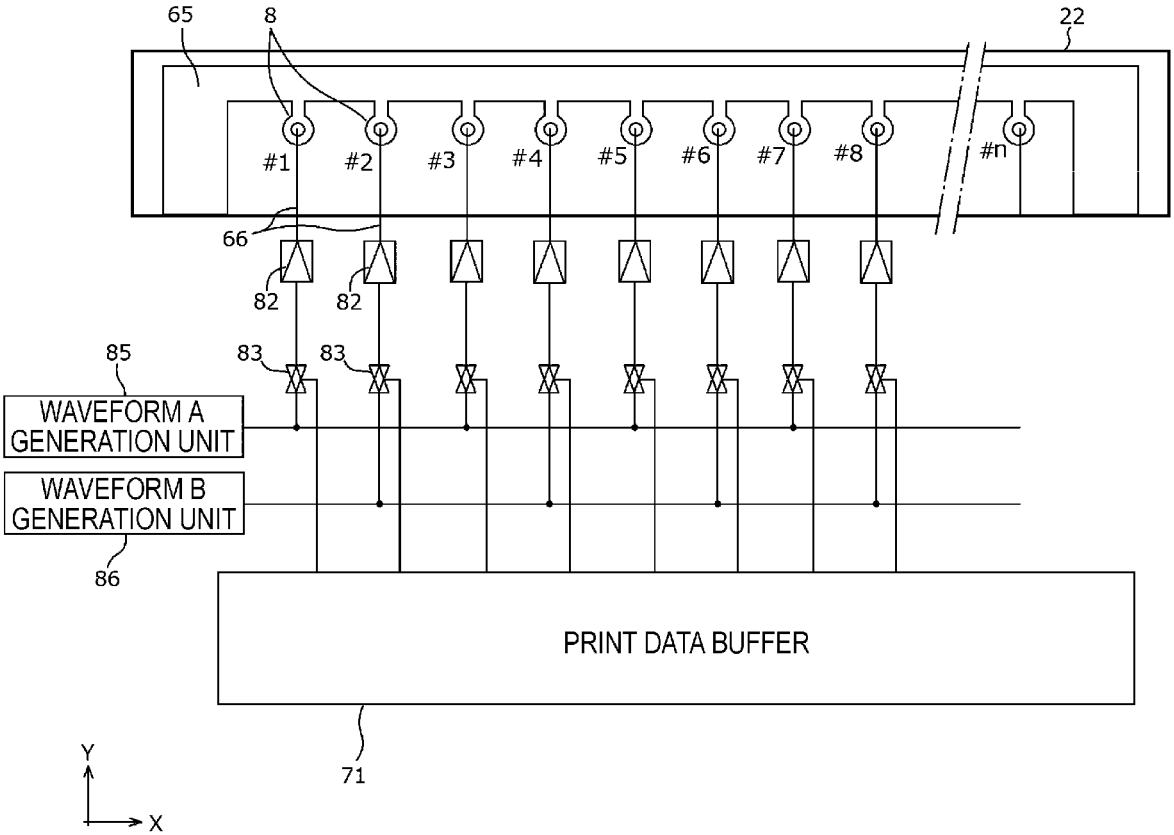
FIG. 10 depicts an actuator drive circuit according to a first embodiment.

FIG. 10 shows an example of an actuator drive circuit that selectively applies the drive waveform A and the drive waveform B to the actuators 8 according to the first embodiment. The actuator drive circuit is formed on the driver 73 of the drive circuit 7 (FIG. 5), for example. The individual electrodes 66 of each actuator 8 connect a drive transistor 82 to a switch 83. The actuators 8 of odd-numbered channels (#1, #3 are connected to a waveform A generation unit 85. The actuators 8 of even-numbered channels (#2, #4 are connected to a waveform B generation unit 86. The application points for the drive waveform A and the drive waveform B are thus alternately allocated such that #1=A, #2=B, #3=A, #4=B, #5=A, #6=B, #7=A, #8=B . . . . The waveform A generation unit 85 and the waveform B generation unit 86 are each examples of a drive waveform generation circuit, but in some examples these units may be combined into one circuit. The print data buffer 71 applies a signal for appropriately turning on the switches 83 to the channels for ejecting ink corresponding to the print data. The predetermined drive waveform A or B is applied, through the drive transistor 82, to the channels for which the respective switch 83 has been turned on.

Figure 11:
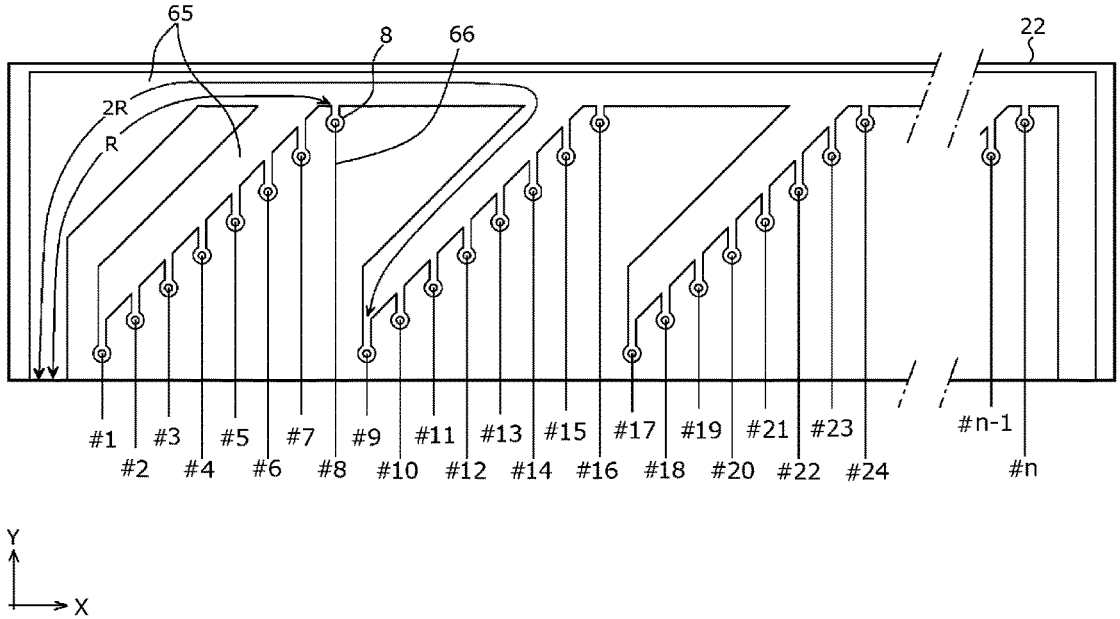
FIG. 11 depicts an example arrangement of actuators and electrodes according to a first embodiment.

In the present first embodiment, an actuator drive circuit or the like applies the drive waveform A or B to the channels that are located at an electrically closest position on the common electrode 65. The electrically closest position on the common electrode 65 is one example of "a close position in a predetermined condition direction" in the present embodiment. Since the channels are arranged at equal intervals along the common electrode 65 extending in the X direction in the example arrangement shown in FIG. 10, the electrically close direction on the common electrode 65 is along the X direction. In an alternative instance, the arrangement direction of the channels is not limited to the X direction, and the channels may be arranged diagonally in the XY directions as shown in FIG. 11. In another instance, in the arrangement of FIG. 10 or 11, the position of the nozzle 5 in the Y direction may be finely adjusted by the delay of the drive timing. Therefore, depending on the wiring direction of the common electrode 65 and the arrangement of the channels, the electrically closest direction may not be the X direction. Also, the electrically closest channels on the common electrode 65 may not necessarily all be adjacent channels to each other. Furthermore, although it is desirable that the position is the electrically "closest" position on the common electrode 65, the electrically close position need not necessarily strictly be the electrically "closest" position as long as cancellation of the current can be still realized.

In the case of FIG. 10, since the voltage drop of the actuator 8 (#6) and the voltage drop of the actuator 8 (#7) are different only by the voltage drop generated in a short line segment between #6 and #7, it can be said that #6 and #7 are electrically close to each other. For example, if the actuators are configured such that #7 is discharged when #6 is charged, the voltage drop is generated only by a short line segment between #6 and #7 and the voltage drop in other portions of the common electrode 65 is not substantially affected.

In the case of FIG. 11, when the relationship between the actuator 8 (#9) and the actuator 8 (#8) is considered, a portion that has common impedance is limited to the area on the left of the actuator 8 (#8). The wiring resistance R of the electric path of the common electrode 65 of the actuator 8 (#8) is half the wiring resistance 2R of the electric path of the common electrode 65 of the actuator 8 (#9). Therefore, a half of the voltage drop that occurs in the electric path of the common electrode 65 up to the actuator 8 (#9) occurs in the portion that has common impedance with the actuator 8 (#8). The portion from the actuator 8 (#8) to the actuator 8 (#9) contributes to the voltage drop of the actuator 8 (#9) but does not contribute to the voltage drop of the actuator 8 (#8). Since this portion also connects with the actuator 8 (#10) and the actuator 8 (#16), the voltage drop of this portion also changes depending on whether or not the actuator (#10) to the actuator 8 (#16) are being driven (charged/discharged). Thus, even when the actuator 8 (#8) and the actuator 8 (#9) have an electrical positional relationship, for example, as long as the actuator 8 (#8) is charged when the actuator 8 (#9) is discharged, charges are transferred between the two, and the effect on voltage drop is small.

As for the relationship between the actuator 8 (#9) and the actuator 8 (#10), the common electrode 65 has common impedance in the whole portion excluding the short line segment between the actuator 8 (#9) and the actuator 8 (#10), and the voltage drop that occurs in the electric path of the common electrode 65 reaching each of the actuator 8 (#9) and the actuator 8 (#10) mostly occurs in the portion having the common impedance. For example, the wiring resistance of the electric path of the common electrode 65 reaching each of the actuator 8 (#9) and the actuator 8 (#10) occurs in a portion where most of the electric impedance is the common impedance. Since a difference in the voltage drop between the actuator 8 (#9) and the actuator 8 (#10) is limited to the slight voltage drop, which is caused by driving the actuator 8 (#9) in the short line segment between the actuator 8 (#9) and the actuator 8 (#10), it can be said that the actuator 8 (#9) and the actuator 8 (#10) are electrically close to each other. In a case of such a condition, for example, if the actuator 8 (#10) is discharged when the actuator 8 (#9) is charged, the voltage drop occurs only in this short line segment between #9 and #10, and the voltage drop in other portions of the common electrode 65 is not affected.

Figure 12:
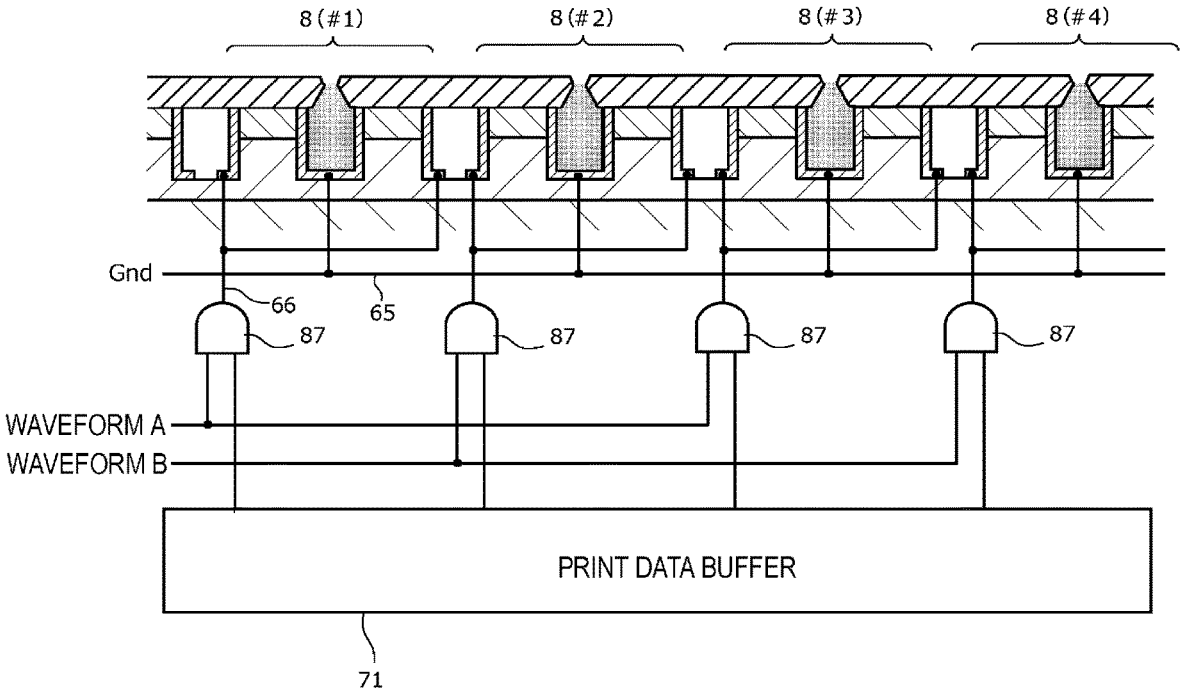
FIG. 12 is a configuration diagram of an actuator drive circuit according to a first embodiment.

FIG. 12 shows an example configuration in which the actuator drive circuit shown in FIG. 10 is applied to the shear mode type actuator 8 shown in FIG. 4. In FIG. 12, the drive transistor 82 and the switch 83 have been omitted, and the configuration thereof has been simplified by collective representation as an AND gate 87.

In the configuration as shown in FIG. 12, as for the actuators 8 driven at the same time, in the portion where the charging timing of the even-numbered actuator 8 (#2, #4 . . . ) matches with the discharging timing of the odd-numbered actuator 8 (#1, #3 . . . ), a current does not flow in the common electrode 65 and a charge is transferred between the even-numbered actuator 8 and the odd-numbered actuator 8. As a result, the voltage drop on the common electrode 65 is suppressed, the ink ejection is stabilized, and the print quality is improved. For example, when the actuator drive circuit of FIG. 10 is used, it is further advantageous that the voltage drop when all the channels eject ink can be suppressed.

In the present embodiment, the phrase "the actuators 8 driven at the same time" includes not only actuators whose drive timings are exactly the same but also actuators whose drive timings are different but drive cycles (for example, the charging cycles and the discharging cycles of the actuators 8) are partially overlapped with each other, in the group of the actuators 8 that eject ink. Further, while one example of the "close position in the predetermined condition direction" is an electrically close position on the common electrode 65, another example may be a position where a separation distance between the pressure chambers 5 is small such that an effect of pressure oscillation can be alleviated or suppressed.

Figure 13:
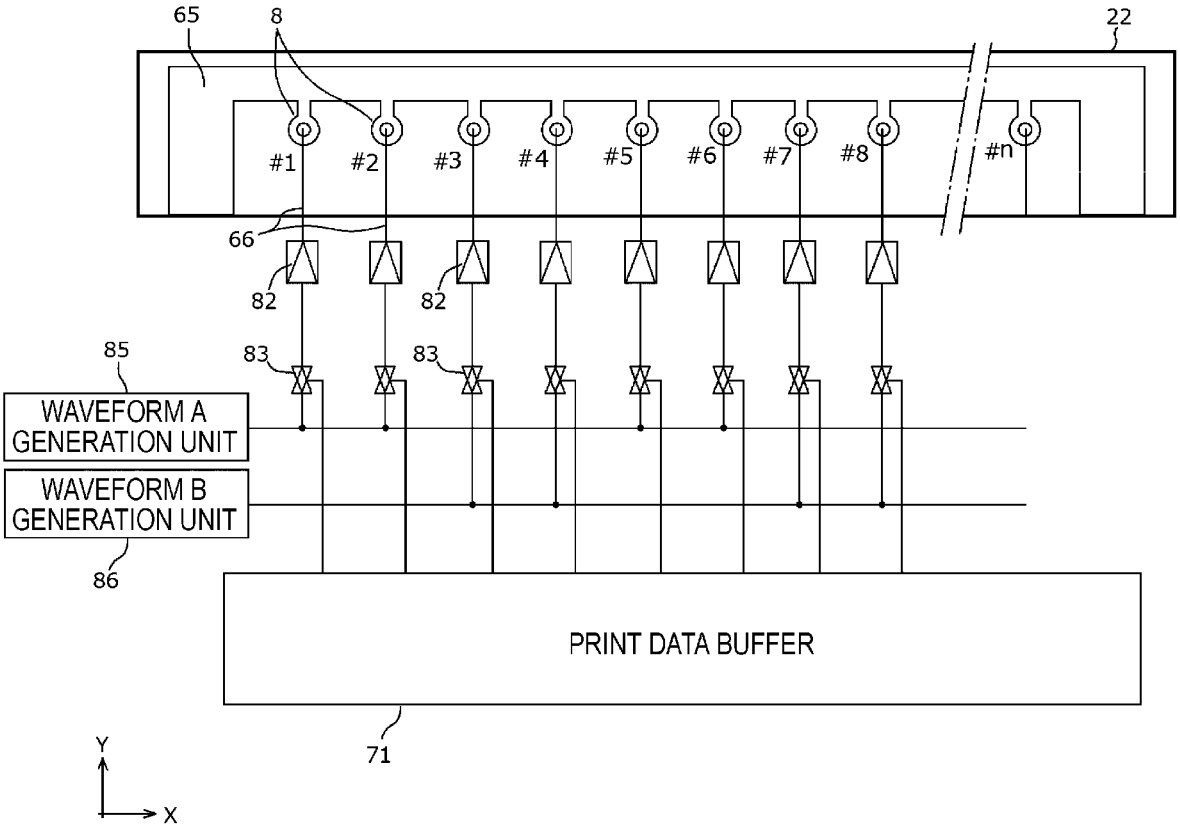
FIG. 13 depicts a modification example of an actuator drive circuit.

FIG. 13 shows a modification example of the actuator drive circuit that selectively applies the drive waveform A and the drive waveform B to the actuators 8. In this modification example, the actuators 8 that apply the drive waveform A and the actuators 8 that apply the drive waveform B are not set alternately one-to-one but rather every other two of the actuators 8 in the arrangement depicted in FIG. 13 are applied with a different waveform. For example, the drive waveform A and the drive waveform B are allocated such that #1=A, #2=A, #3=B, #4=B, #5=A, #6=A, #7=B, #8=B . . . . Also, in this case, in the portion where the charging timing coincides with the discharging timing of the actuators 8 to be driven at the same time, the current does not flow in the common electrode 65 and the voltage drop on the common electrode 65 can be suppressed. For example, when the actuator drive circuit in FIG. 13 is used, there is a further advantage that the voltage drop can be suppressed when driving only the even-numbered channels or the odd-numbered channels at the same time in a case of printing of halftone or the like.

Figure 14:
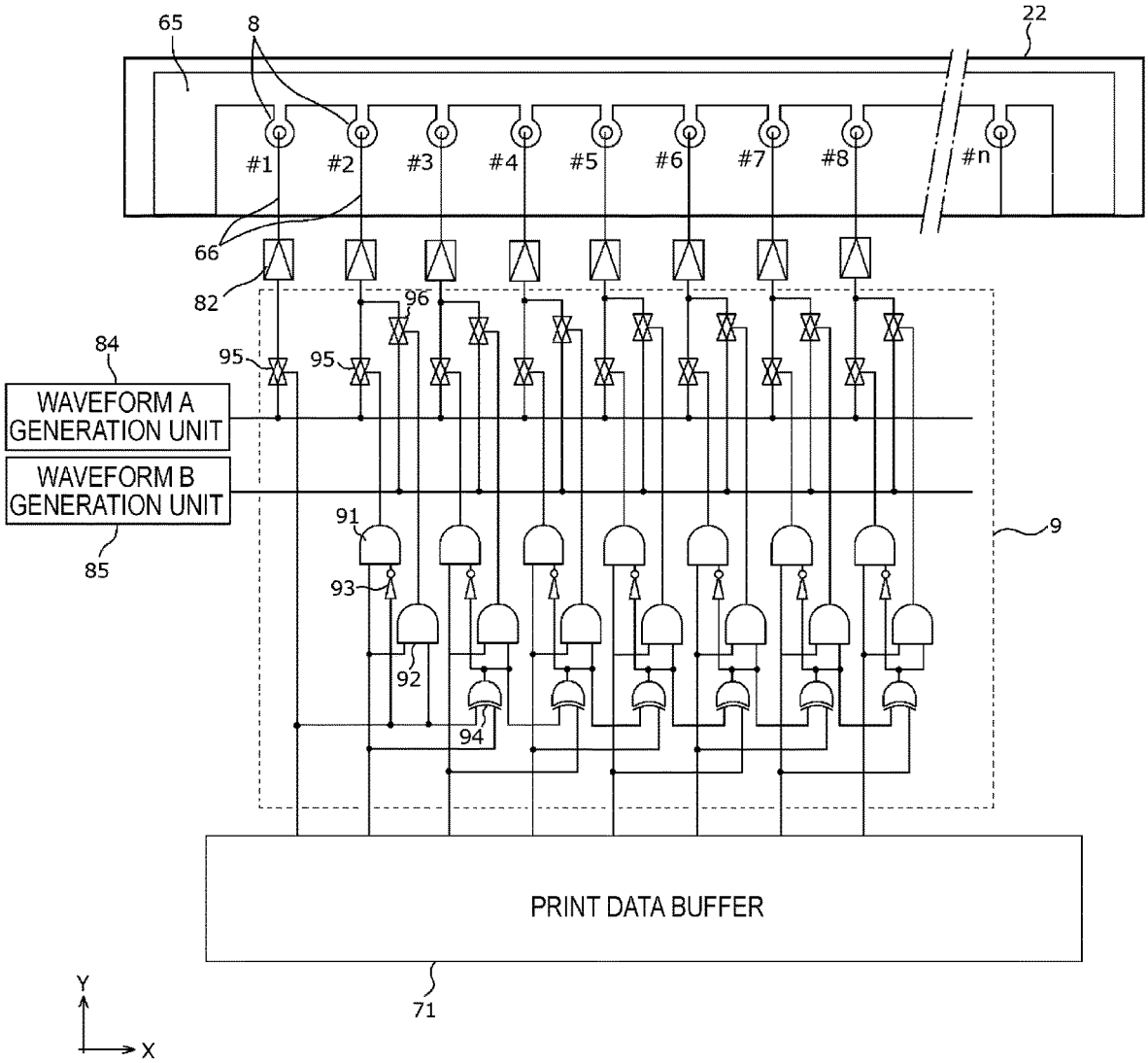
FIG. 14 depicts another modification example of an actuator drive circuit.

FIG. 14 shows another modification example of the actuator drive circuit which selectively applies the drive waveforms A and B to the actuators 8. In the examples of FIGS. 10 and 13, the drive waveform to be applied to each channel is fixed to be either the drive waveform A or the drive waveform B. However, with the actuator drive circuit shown in FIG. 14, which includes a waveform reference selection circuit 9, either the drive waveform A or the drive waveform B can be selectively applied to most channels. Thus, channels at the electrically closest positions on the common electrode 65 among those actuators 8 to be driven at the same time can selectively receive the drive waveform A or B as appropriate. Alternatively, channels to be driven at the same time at the positions for which the physical distance between the pressure chambers 5 is close can selectively receive the drive waveform A or B as appropriate.

The waveform reference selection circuit 9 includes a first AND circuit 91, a second AND circuit 92, a NOT circuit 93, an EXOR circuit (exclusive OR circuit) 94, a first switch 95 on the waveform A side, and a second switch 96 on the waveform B side. With this configuration, which drive waveform is to be applied to the channel can be determined in advance, starting from, for example, channel #1 at the end portion. In the example shown in FIG. 14, the drive waveform A is selected as the waveform to be applied to the first channel (#1) in a fixed manner. However, the second and subsequent channels (from #2 upward) are connected to both the waveform A generation unit 85 and the waveform B generation unit 86, and the waveform reference selection circuit 9 selects which of the waveforms A and B is to be applied to the second and subsequent channels.

For example, when ink is to be ejected from the first (#1), second (#2), third (#3) and fifth (#5) channels at the same time, in the first channel (#1), a signal "1" from the print data buffer 71 is applied to the first switch 95 to turn ON the switch, and the drive waveform A is applied. In the second channel (#2), the signal "1" from the print data buffer 71 is applied to the first AND circuit 91, the signal "1" from the first channel (#1) is set to "0" by the NOT circuit 93, and the set signal is applied to the first AND circuit 91. Thus, the first switch 95 on the waveform A side is turned OFF for the second channel (#2). On the other hand, in the second AND circuit 92, the signal "1" from the print data buffer 71 and the signal "1" from the first channel (#1) are applied to turn ON the second switch on the waveform B side, and the waveform. B is thus applied to the second channel (#2). In the same manner, the drive waveform A is selected for the third channel (#3).

Next, since the fourth channel (#4) is not driven in this example, the signal "0" from the print data buffer 71 is applied to the first AND circuit 91 and the second AND circuit 92, and both switches 95 and 96 are turned OFF. In the fifth channel (#5), the signal "1" from the print data buffer 71 is applied to the first AND circuit 91, and the signal "1", which is output from the EXOR circuit 94 of the fifth channel (#5) in response to both the signal "0" from the fourth channel (#4) and the signal "1" from the EXOR circuit 94 of the fourth channel (#4), is set to "0" by the NOT circuit 93 and applied to the first AND circuit 91. Thus, the first switch on the waveform A side is turned OFF. In the second AND circuit 92, the signal "1" from the print data buffer 71 and the signal "1" from the EXOR circuit 94 are applied to turn ON the second switch 96 on the waveform B side, and the drive waveform B is applied. As a result, the drive waveforms are allocated such that #1=A, #2=B, #3=A, #4=Off, and #5=B. In a case where the fourth channel (#4) is also to be driven, as for the fifth channel (#5), by referring to the drive waveform B applied to the fourth channel (#4), a drive waveform A is selected.

The actuator drive circuit shown in FIG. 14 searches for a driven channel positioned on the left side of a to-be-driven channel in an electrically close direction on the common electrode 65 and checks whether the driven channel on the nearest left side is driven by the drive waveform A or the drive waveform B. Alternatively, the actuator drive circuit searches for a driven channel that is positioned to the left side of the to-be-driven channel for which the physical distance between the pressure chambers 5 is close and checks whether the nearest driven channel on the left side is driven by the drive waveform A or the drive waveform B. The actuator drive circuit selects the drive waveform B for the to-be-driven channel when the drive waveform applied to the driven channel on the nearest left side is A, and selects the drive waveform A for the to-be-driven channel when the drive waveform applied to the driven channel on the nearest left side is B. By using this actuator drive circuit, it is possible to alternately drive the channels with the drive waveform A and the drive waveform B regardless of the print pattern, and it is also possible to cancel the current flowing in the common electrode 65 regardless of the drive pattern. According to the present embodiment, the determination of which drive waveform is to be applied to which channel does not necessarily start from the leftmost channel (#1).

Figure 15:
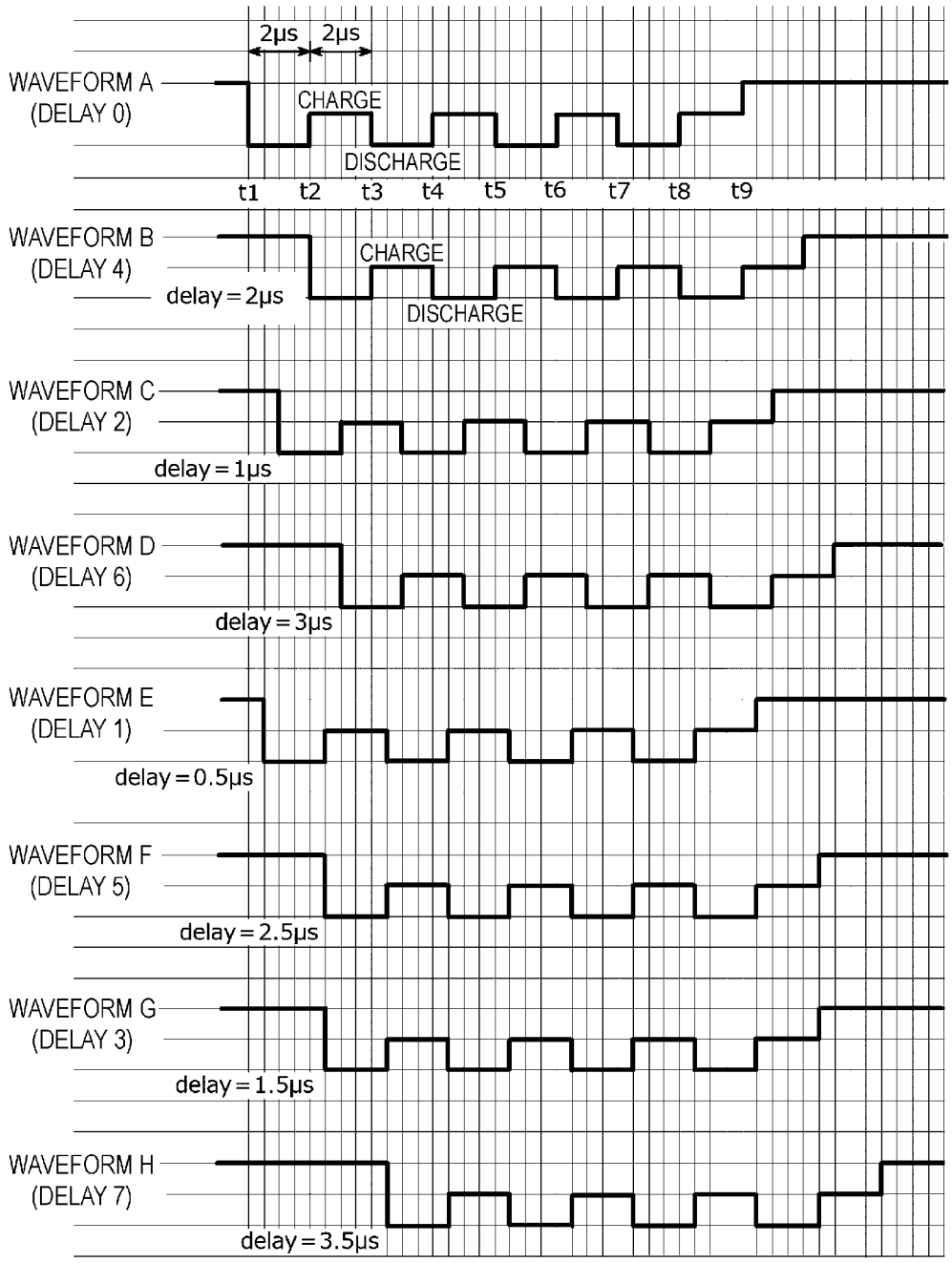
FIG. 15 depicts example actuator drive waveforms.

In the example arrangement shown in FIG. 14 using only the drive waveform A and the drive waveform B, there may be a case where when attempting to cancel the current flowing in the common electrode 65 using the drive waveform B, the current is not canceled at the beginning part (time t1) and the end part (time t9) of the waveform. In order to alleviate the current concentration at the beginning part (time t1) and the end part (time t9) of the waveform, a shorter time delay may be added to the current cancellation of the adjacent channel. As an example, drive waveforms A to H (delay 0 to 7) shown in FIG. 15 can be used. The drive waveform C delays the drive timing with respect to the drive waveform A by one half of the half cycle of the pressure oscillation (delay 2). The drive waveform D delays the drive timing with respect to the drive waveform C by a half cycle of the pressure oscillation (delay 6). The drive waveform E delays the drive timing with respect to the drive waveform A by a quarter of the half cycle of the pressure oscillation (delay 1). The drive waveform F delays the drive timing with respect to the drive waveform E by a half cycle of the pressure oscillation (delay 5). The drive waveform G delays the drive timing with respect to the drive waveform A by three fourths of the half cycle of the pressure oscillation (delay 3). The drive waveform H delays the drive timing with respect to the drive waveform G by a half cycle of the pressure oscillation (delay 7).

Figure 16:
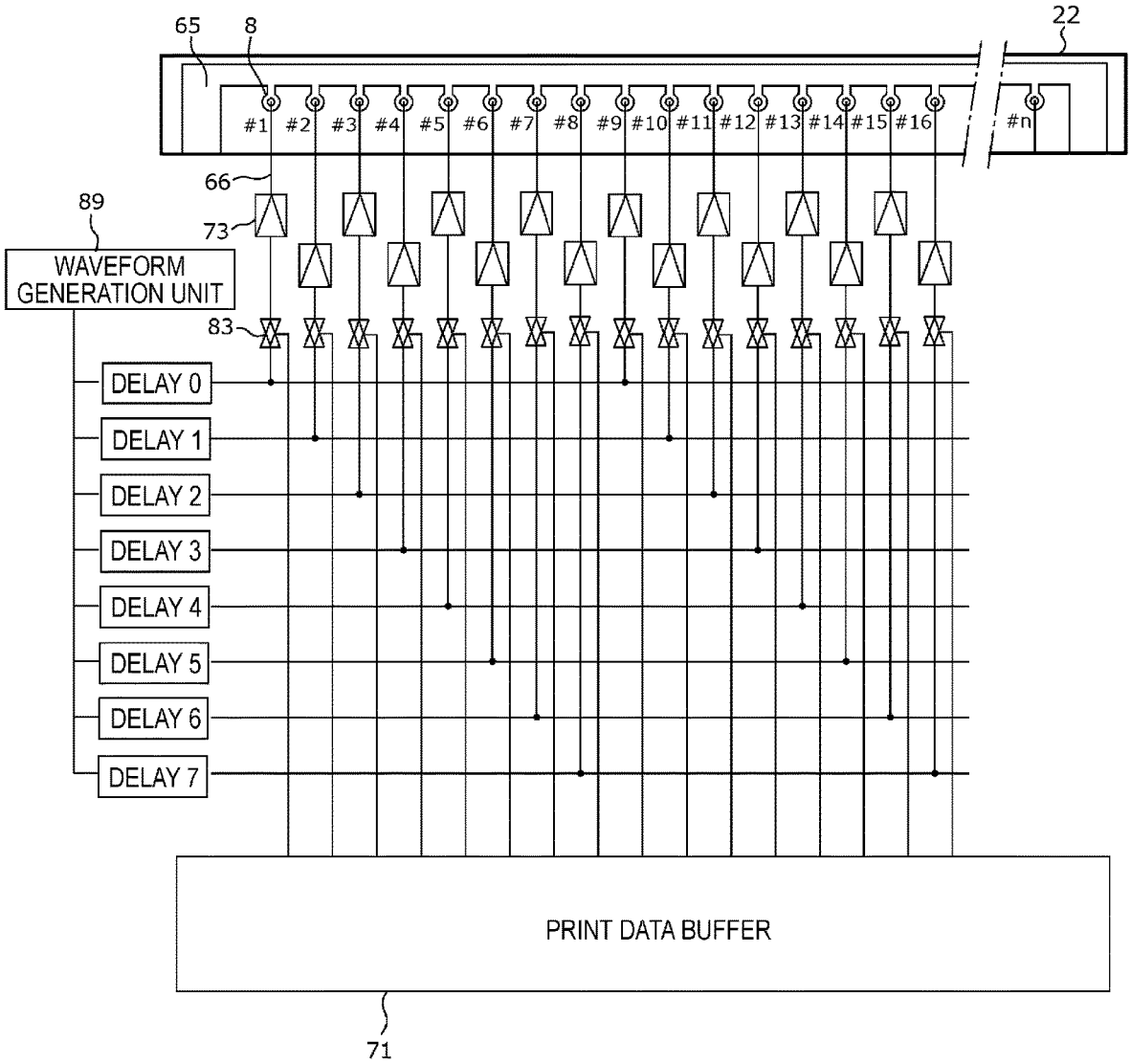
FIG. 16 depicts an actuator drive circuit to which example drive waveforms are applied.

FIG. 16 shows an example of the actuator drive circuit which selectively applies the delays 0 to 7 (that is, drive waveforms A to H) to the actuators 8. The seven drive waveforms A to H from the waveform generation unit 89 are allocated to the first channel (#1) to the eighth channel (#8) in the order of delays 0 to 7. The same is applied to the ninth channel (#9) and the subsequent channels. Each switch 83 can be selectively turned ON by the signal from the print data buffer 71. The print data buffer 71 turns ON the switches 83 of the channels to be driven at the same time. Thus, each channel is driven by the drive waveforms A to H allocated to the respective channels. When the actuator drive circuit in FIG. 16 is used, the charging current and the discharging current of the actuators 8 of the channels #1 and #2, #3 and #4, #5 and #6, and #7 and #8 mutually cancel the current flowing in the common electrode 65, and at the beginning timing (time t1) and the end timing (time t9) for the waveform that cannot be canceled, the current is dispersed to suppress the voltage drop of the common electrode 65. As a result, ink ejection stabilizes, and printing quality improves.

Figure 17:
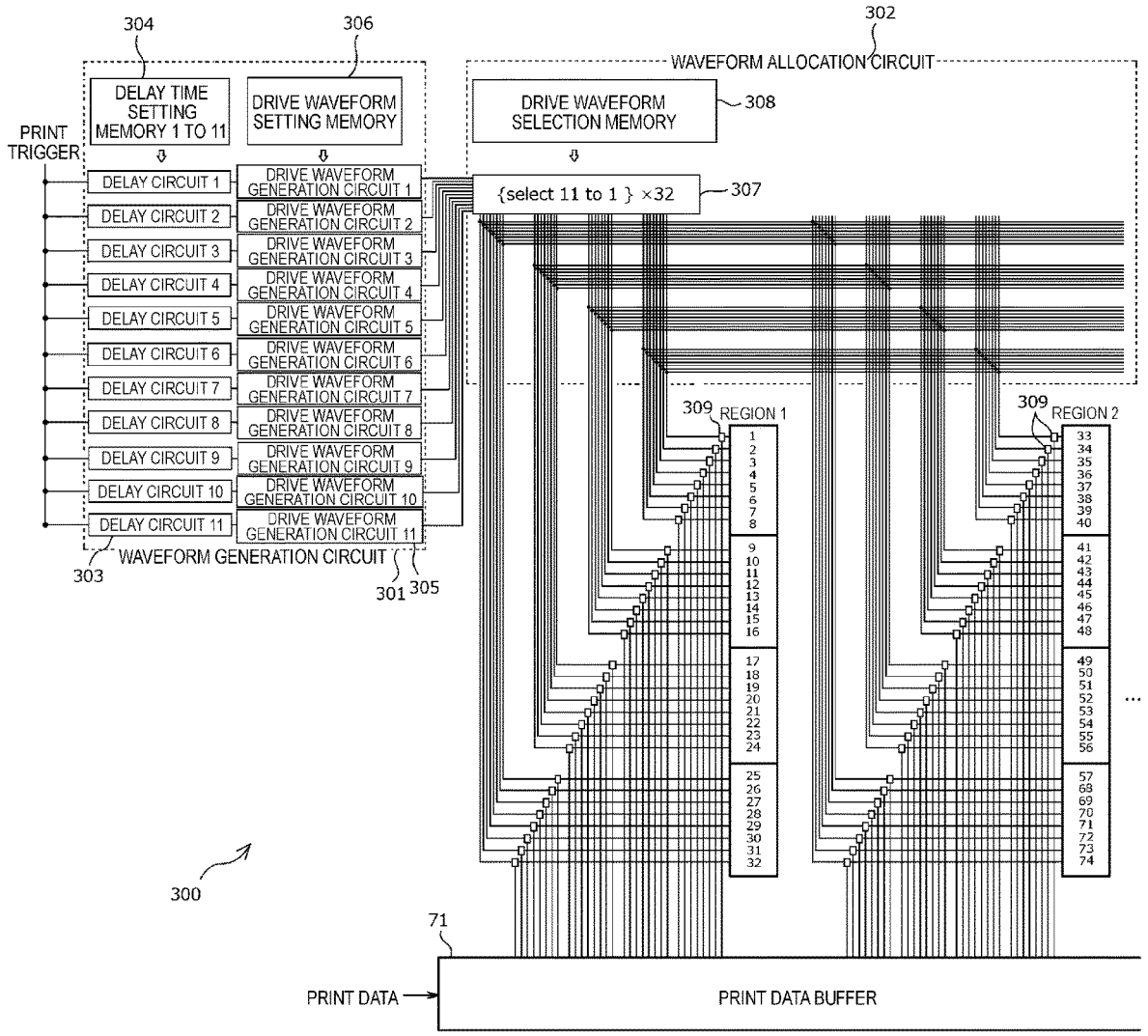
FIG. 17 depicts a modification example of an actuator drive circuit to which example drive are applied.

The actuator drive circuit that applies a plurality of drive waveforms to the actuators 8 may be configured in a programmable manner. FIG. 17 shows an example of an actuator drive circuit 300 capable of generating the plurality of drive waveforms corresponding to the drive waveforms A to H by allocating a delay time to each actuator in a programmable manner using the drive waveform shown in FIG. 6 as a common drive waveform. By the actuator drive circuit 300, it is possible to determine to which channels the drive waveforms A to H are allocated at which drive timings among the drive timings (delays 0 to 7), and to start generating the drive waveforms A to H at the allocated drive timings.

The actuator drive circuit 300 includes a waveform generation circuit 301 and a waveform allocation circuit 302. The waveform generation circuit 301 includes a plurality of delay circuits 303, a delay time setting memory 304, a plurality of drive waveform generation circuits 305, and a drive waveform setting memory 306. The plurality of delay circuits 303 and the plurality of drive waveform generation circuits 305 are connected in series, respectively. There are eleven pairs of the delay circuits 303 and the drive waveform generation circuits 305, for example.

In the drive waveform setting memory 306, common drive waveform information is stored. In this example, the drive waveform shown in FIG. 5 is a common drive waveform. In the delay time setting memory 304, the set values of the delay amounts for delay 0 to delay 7 are stored. For the drive waveforms A to H, the set values are delay 0 (0.00 μs), delay 1 (0.50 μs), delay 2 (1.00 μs), delay 3 (1.50 μs), delay 4 (2.00 μs), delay 5 (2.50 μs), delay 6 (3.00 μs), and delay 7 (3.50 μs), for example.

The waveform allocation circuit 302 includes a selector 307 and a drive waveform selection memory 308. In the drive waveform selection memory 308, one or more "allocation patterns" that set which of the delay amounts 0 to 7 are to be allocated to which of the channels are stored. FIG. 18 shows example allocation patterns. As shown in FIG. 18, in for different allocation patterns (left page portions of FIG. 18), delays selected from among the eight different kinds of delays (delay 0 to 7) are allocated to a matrix with 4 columns and 8 rows. In the table shown in FIG. 18, the vertical and horizontal axes do not necessarily represent the structural row and column positions of the actuators 8, but the delay in the row n, column m position of a table corresponds to the delay for the (n+(m−1)×8)th channel. FIG. 18 also shows (right page portions) the delay times allocated to each channel using the corresponding allocation pattern. For convenience of drawing, the 13th and subsequent rows are omitted from the depiction in FIG. 18 (right page portions), but the 13th and subsequent rows are similarly allocated with delay times according to the respective allocation patterns.

The selector 307 is, for example, a selector for the "11 to 1" portion of the 32 channels (ch). The selector 307 is connected to each of an output end of each drive waveform generation circuit 305. Further, output ends of the 32 chs connected the selector 307 are connected to the channels through the switches 309, respectively.

With respect to the channels, eight channels form one set, and four sets of channels (for a total of 32 channels in a channel group) constitute one region. For example, seven regions (not at all separately depicted) are provided in total. Furthermore, in some examples, a plurality of channels can share the same channel (ch) among the seven regions so that the channel 1 of the region 1 and the channel 33 of the region 2 are the same channel (ch). Each switch 309 selectively controls whether to apply the drive signal from the selector 307 to each of the channels. The print data buffer 71 turns ON the switches 309 of the channels that are to be driven at the same time.

In the drive circuit 300 according to the present first embodiment, when a print trigger is applied to the delay time setting memory 304, each of the delay circuits 303 waits for the respective delay time (0.00 μs to 3.50 μs) to elapse and then activates each of the drive waveform generation circuits 305. The drive waveform generation circuits 305 output the drive waveforms stored in the drive waveform setting memory 306. Therefore, the generation start timings of the drive waveforms differ from each other by the difference of the respective delay amounts.

The drive waveforms from the respective drive waveform generation circuits 305 are applied to the selector 307. The selector 307 distributes the drive waveforms (which have different generation start times) to the channels according to the allocation pattern (having 8 rows and 4 columns) stored in the drive waveform selection memory 308. Then, the allocation pattern is shifted in the +X direction and repeatedly applied to allocate the drive waveforms to all the channels that are two-dimensionally arranged (see FIG. 18). Each drive waveform allocated by the selector 307 is applied to the actuator 8 of the channel whose switch 309 is turned ON.

Second Embodiment

Next, an inkjet head 400 according to a second embodiment will be described with reference to FIGS. 19 and 20. The inkjet head 400 of the second embodiment has the same or substantially the same configuration as that of the first embodiment except that drive waveforms having completely opposite phases are generated and applied to the actuators 8 at the same drive timing, for example. Thus, the same configuration elements, components, or the like will be denoted by the same reference numerals as those of the first embodiment, and the detailed description thereof will be omitted.

Figure 19:
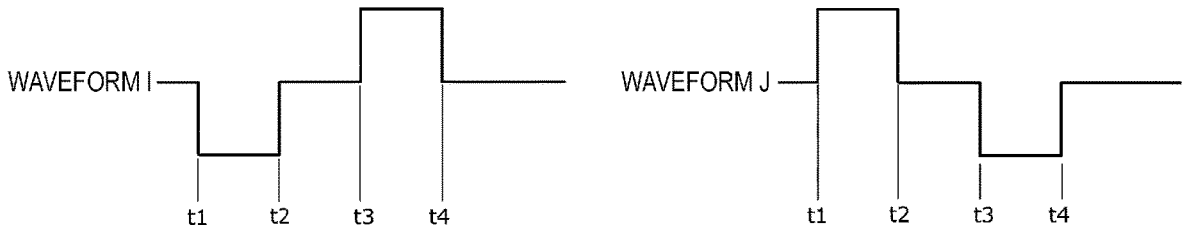
FIG. 19 depicts example actuator drive waveforms according to a second embodiment.

FIG. 19 shows drive waveforms I and J that form dots by dispensing ink once in one drive cycle, as an example of the drive waveforms of completely opposite phases. In the drive waveform I, a negative voltage is applied to the actuator 8 as a bias voltage from time t1 to time t2. Then, voltage V0 (=0 V) is applied from time t2 (that is when the ink ejection operation is started) to time t3. Then, the ink is dispensed by applying a positive voltage from time t3 to time t4.

In the drive waveform J, a positive voltage is applied to the actuator 8 as a bias voltage from time t1 to time t2. Then, voltage V0 (=0 V) is applied from time t2 to time t3. Then, the ink is dispensed by applying a negative voltage from time t3 to time t4. The drive waveform I and the drive waveform J are thus inverted from each other.

Figure 20:
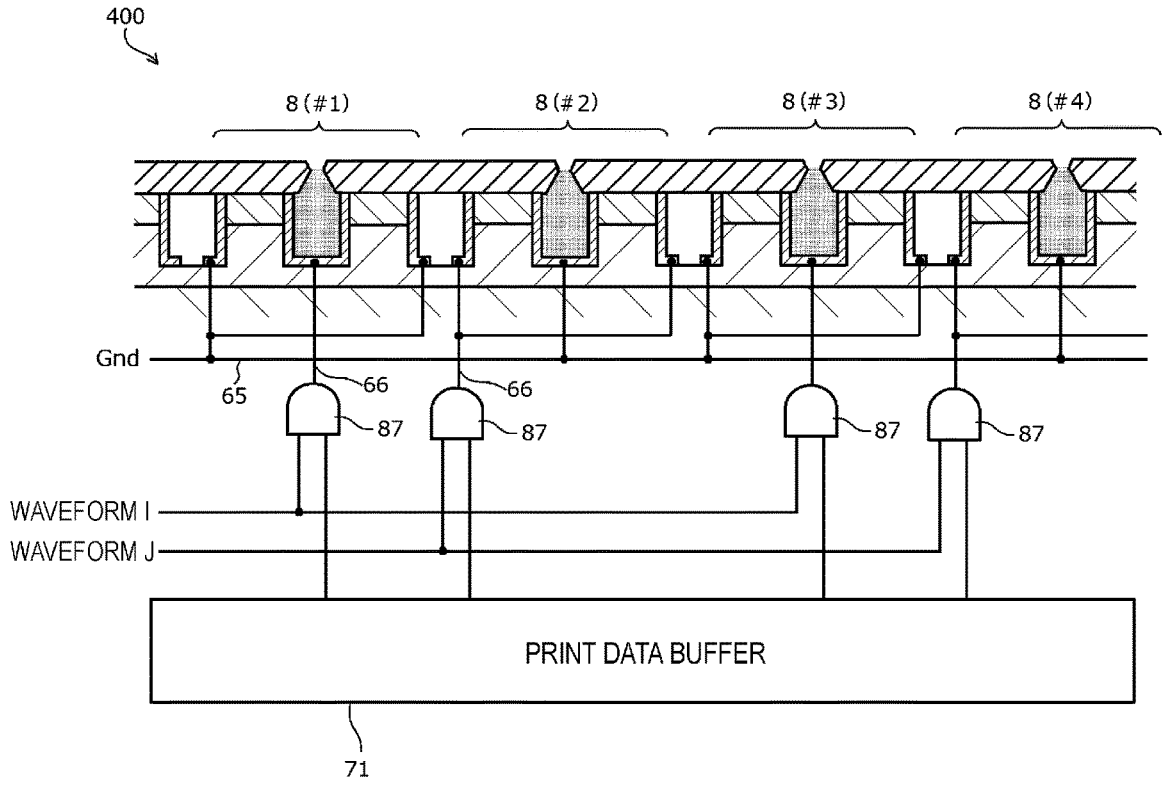
FIG. 20 is a configuration diagram of an actuator drive circuit according to a second embodiment.

As shown in FIG. 20, for the even-numbered actuators 8 (#2, #4 . . . ), the electrode 63 of a pressure chamber 5 is grounded to the ground (Gnd) through the common electrode 65, and a drive waveform is applied to the electrode 64 of the air chamber 51 through an individual electrode 66 (similar to FIG. 12). The drive waveform to be applied is the drive waveform J, for example. For the odd-numbered actuators 8 (#1, #3 . . . ), the electrode 64 of the air chamber 51 is grounded to the ground (Gnd) through the common electrode 65, and a drive waveform is applied to the electrode 63 of the pressure chamber 5 through an individual electrode 66. The drive waveform to be applied is, for example, the drive waveform I. That is, the even-numbered actuators 8 (#2, #4 constitute a first group of actuators 8 that pressurize the pressure chambers 5 when positive voltages are applied, and the odd-numbered actuators 8 (#1, #3 constitute a second group of actuators 8 that pressurize the pressure chambers 5 when negative voltages are applied.

In the inkjet head 100 of the first embodiment, the drive waveforms in which the drive timings are shifted are applied to cancel the current of the common electrode 65. In the inkjet head 400 of the second embodiment, the drive waveform I is applied to some actuators 8 at the same time the drive waveform J is applied to some other actuators 8. That is, in the same operation, the first group of actuators 8 (even-numbered actuators 8) and the second group of actuators 8 (odd-numbered actuators 8) receive drive waveforms I and J having completely opposite phases. Thus, drive waveforms I and J can be applied at the same drive timing. Since a period of time in which a positive voltage is applied matches with a period of time in which a negative voltage is applied in the drive waveform I and the drive waveform J, even when the actuators 8 are driven at the same time, the current of the common electrode 65 can be canceled.

According to any of the present embodiments, when the number of actuators 8 to be driven is large, particularly when some of the actuators to be driven are disposed at electrically close positions, current concentration on the common electrode 65 can be suppressed. As a result, it is possible to stabilize liquid ejection parameters such as the ejection speed and the ejection amount. For example, in a sequential supply type process, when a voltage drop might occur in the common electrode 65, a difference in the actuator drive voltage actually applied to some of the actuators 8 may be different from some others or the intended drive voltage. As a result, liquid ejection characteristics may be uneven across the plurality of actuators 8, which may cause uneven density of dispensed ink droplet on the printing surface. However, according to the present embodiments, it is possible to suppress the voltage drop that might otherwise occur on the common electrode 65 that is connected to the plurality of actuators 8, thereby uneven printing density can be avoided or reduced. Alternatively, by applying the present embodiments in such a manner that the drive waveforms with different drive timings are applied to the actuators 8 at the positions in which the physical distance between the pressure chambers 5 is close, an influence of pressure oscillation between the channels can be alleviated, and thus the liquid ejection can be stabilized.

The inkjet head 100 is not limited to the shear mode type actuator 8 in which the ejection channels and the dummy channels are alternately arranged. For example, the plurality of nozzles 25 and the plurality of actuators 8 may be arranged on the surface of the nozzle plate 5. Other droplet-on-demand type piezoelectric actuators may be used as the actuators 8.

In the present embodiments, an inkjet head 100 (or 400) of an inkjet printer 10 has been described as an example of a liquid ejection apparatus 1. In other embodiments, the liquid ejection apparatus 1 may be a molding material ejection head of a 3D printer or a sample ejection head of a liquid dispensing apparatus.

While certain embodiments have been described, these embodiments have been presented by way of example only and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid ejection apparatus, comprising:

a liquid ejection unit including a plurality of nozzles and a corresponding plurality of actuators;

a drive waveform generation circuit configured to generate a plurality of drive waveforms having different drive timings; and an actuator drive circuit configured to apply a first drive waveform to a first actuator in a liquid ejection operation and determine whether a second actuator is to be driven at a same nominal time as the first actuator in the liquid ejection operation and apply a second drive waveform to the second actuator in the liquid ejection operation when the second actuator is to be driven at the same nominal time as the first actuator in the liquid ejection operation, wherein the first and second drive waveforms have different drive timings, and the first actuator is at a position electrically closer along a predetermined direction to a power supply electrode than is the second actuator.

2. The liquid ejection apparatus according to claim 1, wherein the actuator drive circuit is configured to set the second drive waveform by reference to the first drive waveform.

3. The liquid ejection apparatus according to claim 1, wherein at least one actuator that is not to be driven at the same nominal time as the first actuator is between the first and second actuators.

4. The liquid ejection apparatus according to claim 1, wherein the second drive waveform has a phase opposite to that of the first drive waveform.

5. The liquid ejection apparatus according to claim 1, wherein the second drive waveform corresponds to the first drive waveform with a delay added thereto.

6. The liquid ejection apparatus according to claim 5, further comprising:

a memory storing a delay allocation table, wherein the actuator drive circuit adds the delay based on the delay allocation table.

7. The liquid ejection apparatus according to claim 1, wherein each of the actuators has a first terminal connected to a common electrode and a second terminal connected to an individual electrode to which the drive waveforms are applied for each actuator.

8. The liquid ejection apparatus according to claim 7, wherein the power supply electrode is the common electrode.

9. The liquid ejection apparatus according to claim 8, wherein the first actuator is at an electrically closest position on the common electrode to the second actuator.

10. The liquid ejection apparatus according to claim 1, wherein the actuator drive circuit includes a plurality of logic gates between a print data buffer and the plurality of actuators.

11. A liquid ejection apparatus, comprising:

a liquid ejection unit including a plurality of nozzles and a corresponding plurality of actuators;

a drive waveform generation circuit configured to generate a plurality of drive waveforms having different drive timings;

a plurality of pressure chambers, each pressure chamber being connected to a respective nozzle of the plurality of nozzles; and an actuator drive circuit configured to apply a first drive waveform to a first actuator in a liquid ejection operation and determine whether a second actuator is to be driven at a same nominal time as the first actuator in the liquid ejection operation and apply a second drive waveform to the second actuator in the liquid ejection operation when the second actuator is to be driven at the same nominal time as the first actuator in the liquid ejection operation, wherein the first and second driving waveforms have different drive timings, and the actuator drive circuit is configured to select the second drive waveform by reference to the first drive waveform applied to the first actuator.

12. The liquid ejection apparatus according to claim 11, wherein the second actuator is nearest to the first actuator along a predetermined direction corresponding to the direction in which a separation distance between pressure chambers is shortest.

13. The liquid ejection apparatus according to claim 11, wherein at least one actuator is between the first and second actuators along the predetermined direction.

14. The liquid ejection apparatus according to claim 11, wherein the second actuator is the physically closest actuator to the first actuator along a predetermined direction.

15. The liquid ejection apparatus according to claim 12, wherein the second drive waveform has a phase opposite to that of the first drive waveform.

16. The liquid ejection apparatus according to claim 12, wherein the second drive waveform corresponds to the first drive waveform with a delay added thereto.

17. The liquid ejection apparatus according to claim 16, further comprising:

a memory storing a delay allocation table, wherein the actuator drive circuit adds the delay based on the delay allocation table.

18. A method for ejecting liquid from a liquid ejection head, comprising:

selecting a first actuator from among a plurality of actuators of a liquid ejection head which are to be driven at the same nominal time;

determining whether a second actuator that is electrically closest to the first actuator along a predetermined direction is among the plurality of actuators of the liquid ejection head which are to be driven at the same nominal time;

applying first drive waveform to the first actuator; and applying a second drive waveform to the second actuator if the second actuator is among the plurality of actuators of the liquid ejection head which are to be driven at the same nominal time, wherein the first driving waveform is different from the second driving waveform, and the first actuator is at a position electrically closer along the predetermined direction to a power supply electrode than is the second actuator.

19. The method according to claim 18, wherein the second drive waveform has a phase opposite to that of the first drive waveform.

20. The method according to claim 18, wherein the second drive waveform corresponds to the first drive waveform with a delay added thereto.

* * * * *